US006188006B1

(12) United States Patent
Mc Govern

(10) Patent No.: US 6,188,006 B1
(45) Date of Patent: Feb. 13, 2001

(54) HAND PLAYED MUSIC BOX—LIKE MUSICAL INSTRUMENT

(76) Inventor: James Robert Mc Govern, 63 B Independence Ct., Yorktown Heights, NY (US) 10598

( * ) Notice: Under 35 U.S.C. 154(b), the term of this patent shall be extended for 0 days.

(21) Appl. No.: 09/298,885

(22) Filed: Apr. 26, 1999

(51) Int. Cl.[7] ..... G10B 3/10

(52) U.S. Cl. ..... 84/363; 84/351; 84/352; 84/94.1; 84/94.2

(58) Field of Search ..... 84/363, 351, 352, 84/360, 364, 365, 376 R, 375, 94.1, 94.2, 95.4, 95.1

(56) References Cited

U.S. PATENT DOCUMENTS 3,311,010 * 3/1967 Ward ..... 84/376
3,665,092 * 5/1972 Heiman ..... 84/351
4,275,635 * 6/1981 Maric ..... 84/376 R
5,070,755 * 12/1991 Carroll ..... 84/600
5,824,927 * 10/1998 Tonon ..... 84/375

* cited by examiner

*Primary Examiner*—Jeffrey Donels
*Assistant Examiner*—Kim Lockett

(57) ABSTRACT

An electrically Powered Hand Played Music Box has;

a base frame that carries a plurality of 88 damped reed/plectrum tone producing assemblies that can be mechanically accessed in groups of 29 sequenced assemblies each, and placed in correspondence with the keys of a 29 key keyboard so that the player can flexibly select the key that a tune can be played in;

an inclined face surface that carries a detachable tune board that carries, according to manufacture, a pre-set or moveable electrical contact for each assembly tone contained in a sequence of tune tones;

an electromagnetically propelled switching mechanism that travels a track where it engages remote electrical lines to the tune board contacts and actuates the assemblies that produce the sequenced tones;

a tone amplifying microphone, and a speaker;

and a key on a single key keyboard that a player taps to actuate the switching mechanism and provide tempo and rhythm to the assembly produced tones.

12 Claims, 18 Drawing Sheets

FIG. 1

NOTE:

1) B CIRCUIT TO LIFT 35, THRU CONTACT 247, TO EM 23, PULL SHUTTLE TO RT., — B TO +

2) B' CIRCUIT TO LIFT 36, THRU CONTACT 248, TO EM 22, PULL SHUTTLE TO LEFT, — B' TO +

(INVERTED VIEW)

(INVERTED VIEW)
CHROMATIC
MIDDLE 'C'
971
(29)
(1)
95
96
102
107
108
109
105
106
118

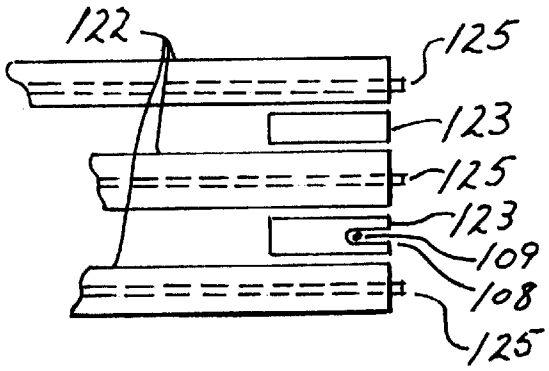
FIG. 18
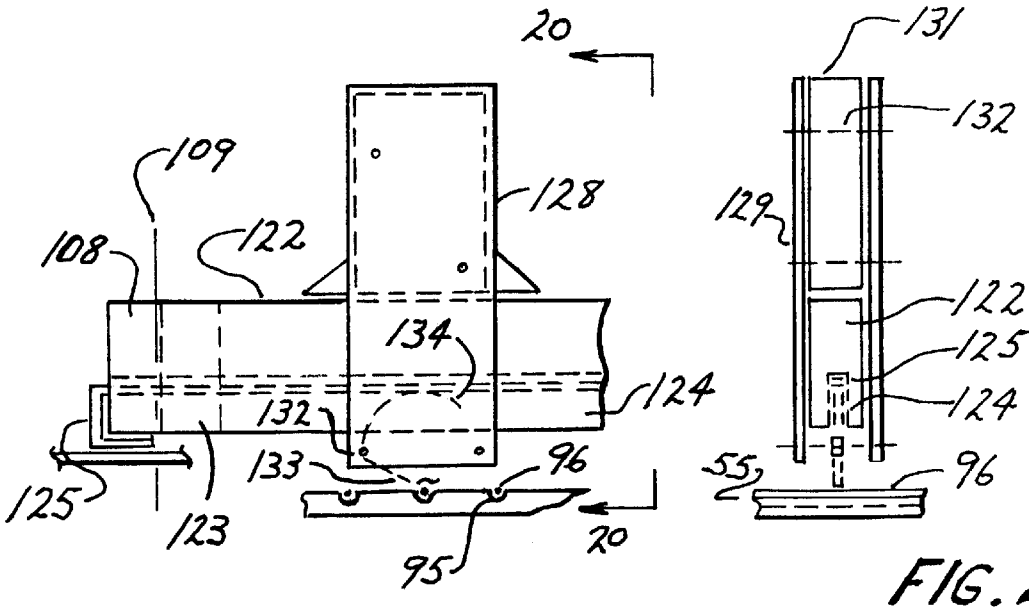
FIG. 19
FIG. 20

HAND PLAYED MUSIC BOX— LIKE MUSICAL INSTRUMENT

BACKGROUND OF THE INVENTION

1. Field of the Invention

This invention relates to mechanical devices that are used to produce music, but more specifically it relates to devices that employ dampened reed/plectrum assemblies, to produce authentic musical notes.

2. Prior Art

It seems there is a latent desire, in music loving people to "play music" that is considered acceptable, but requires a very minimum expenditure of time and effort. And it seems that this hypothetical need has not been addressed by the Art.

SUMMARY OF THE PRESENT INVENTION

It is therefore a primary object of the present invention to provide an instrument that can be used to play a musical tune by rhythmically tapping on the instruments single tap key.

Another object of the invention is to provide an instrument that produces authentic musical note sounds as opposed to producing imitation musical note sounds.

Another object of the invention is to provide an instrument that produces music that sounds like the music that is produced by a music box.

Another object of the invention is to provide an instrument that carries 88 individual dampened reed/plectrum shuttle mechanism assemblies that are capable of producing 88 chromatic musical note sounds.

Another object of the invention is to provide an instrument that includes a means of accessing any 29 side-by-side musical note producing assemblies group for use in playing a given musical tune.

Another object of the invention is to provide an instrument that can employ manufactured tune boards that carry a configuration of pre-set tune circuit contacts that can be switched on and off, in sequence, to provide tone sounds that constitute a musical tune.

Another object of the invention is to provide an instrument that can employ tune boards that can carry moveable tone circuit contacts that can be moved into a composed tune configuration and switched on and off in sequence to play the tune.

Another object of the invention is to provide an instrument that carries a 29 key board, the keys of which correspond to the 29 assemblies that are accessed, so that assembly tones can be sampled and selected for use in tune composition.

Another object of the invention is to provide an instrument with 29 fixed circuit lines in what is identified as a tune network base, the lines of which are an extension of, and correspond to, the 29 assemblies that have been made available, so that fixed or moveable contacts can be connected to them.

Another object of the invention is to provide an instrument that employs a battery powered electrical current source.

Another object of the invention is to provide an instrument that employs a battery powered, movable, track guided, pendulum paddle propelled, mechanism, to switch the assembly tune circuits of a given tune, on and off.

Another object of the invention is to provide an instrument with a switching mechanism that can be flexibly moved onor easily removed from its track.

Another object of the invention is to provide an instrument that carries a microphone, a speaker, and a current controller, to suitably amplify the musical sounds produced by the instrument's assemblies.

Another object of the invention is to provide an instrument on which tune composing or tune transposing to accomodate a key requirement can be performed by simple recognition of the sound of the tunes first note, and location and placement of that note's circuit contact on the composers tune board.

Another object of the invention is to provide an instrument that carries an electrical power switch to turn the instrument on or off.

Other objects of the invebtion will become apparent as new insights are gained from the application and use of this new instrument.

DESCRIPTION OF THE DRAWINGS

FIG. 18 is a top view of a section of a composing tune board that shows how ribs that carry tune conductor lines are spaced apart by spacer pieces, in the construction of the board.

FIG. 19 is an elevation view of the moveable tune circuit contact that is referred to in FIG. 17 .

FIG. 20 is an end elevation view of the moveable tune circuit contact shown in the FIG. 19 drawing.

DETAILED DESCRIPTION OF THE INVENTION

Figure 1:
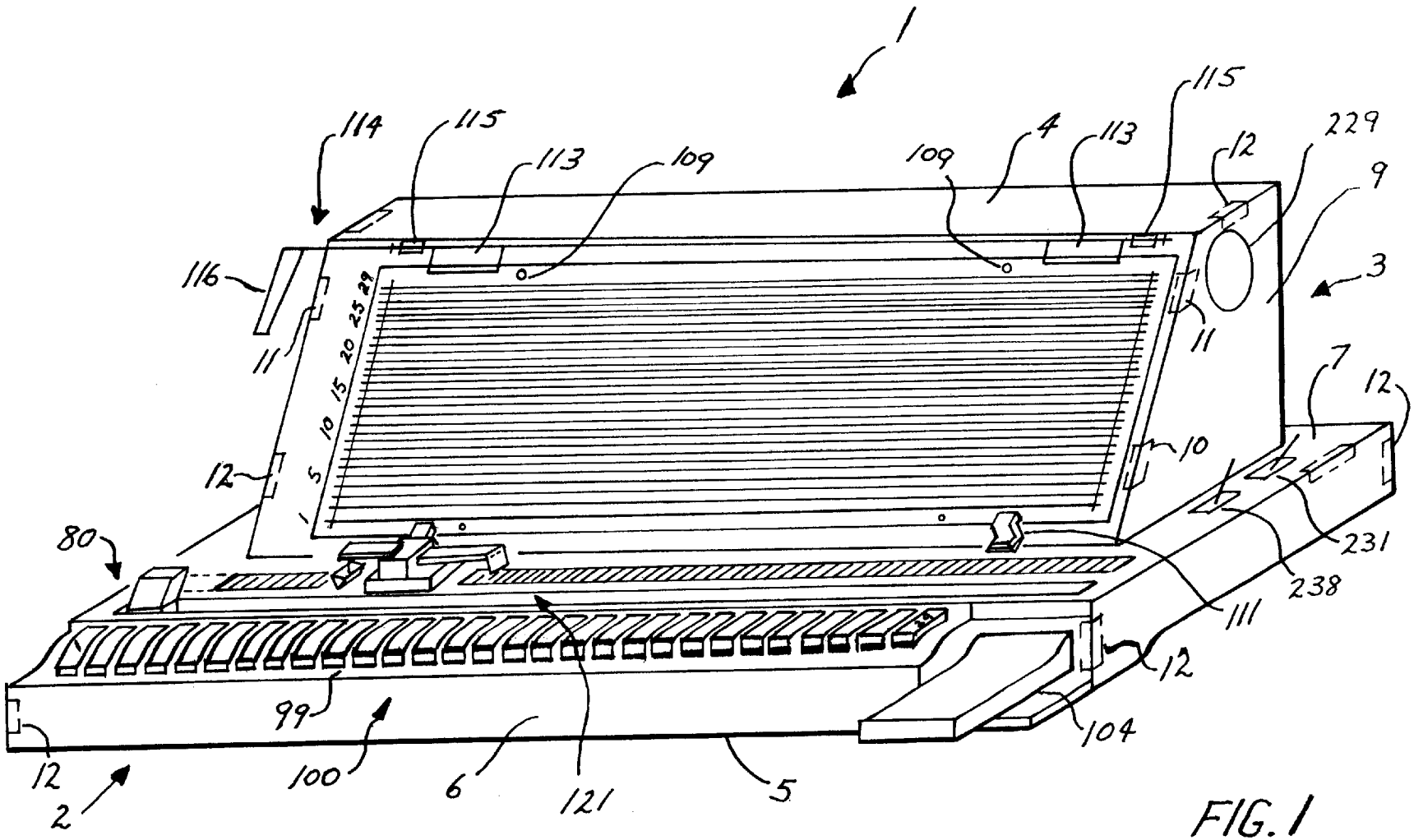
FIG. 1 is a perspective view of a musical instrument that is played by rhythmically tapping the instrument's single tap key.

A Mechanical electrically powered, hand played music box comprises and is provided with the following:

A. Instrument Enclosure Components (see FIG. 1)

a. Construct an enclosure for the instrument 1.

b. Provide a rectangular base 2, and a trapezoidal shaped top 3 made of panels such as 4, 5, 6, 7, 8, and 9, etc.

c. Structurally support the panels with structural angles such as 10, 11, and 12, etc. to achieve the equivalent of a framed enclosure.

B. Assemblies that produce musical tones (see FIG. 2)

a. Provide 88 damped reed/plectrum musical tone producing shuttle mechanism assemblies 13.

1) The 88 assemblies produce a chromatic scale of 88 tones.

2) The 88 assemblies are fastened side by side on the bottom surface of the trapezoidal enclosure 3, and stabelized by elongated L bracket 258.

b. Provide a trapezoidal shaped plastic cast frame 14, to carry the apparatus of each assembly 13.

1) The assembly shuttle mechanism 15, provides back and forth reed 16 plucking motion by a plectrum 17. It is fastened to the bottom horizontal member 18 of the frame 14.

2) A shuttle body 19 resembles an inverter T. It can be slid back and forth, carried in a modified U shaped track 20.

3) Each shuttle body 19, carries a horizontal stabelizing rod 21 that passes through and is fastened in the body 19. The ends of the rod 21 extend through the mechanism's left side attractor electromagnet 23 (a horizontal hole 24 is provided through each electromagnet) and into an elongated tube 25 and 26, that is stationarily fastened to the assembly frame 14. (cont. ref. to FIG. 2) Each tube 25 and 26, contains a recoil spring 27. Each rod 21 end carries a circular piece 28 that encounters and compresses the spring 27, and eases stopping the shuttle body's 19 travel. The attractor magnets 22 and 23, are fastened to the bottom horizontal member of the assembly frame 14.

Figure 12:
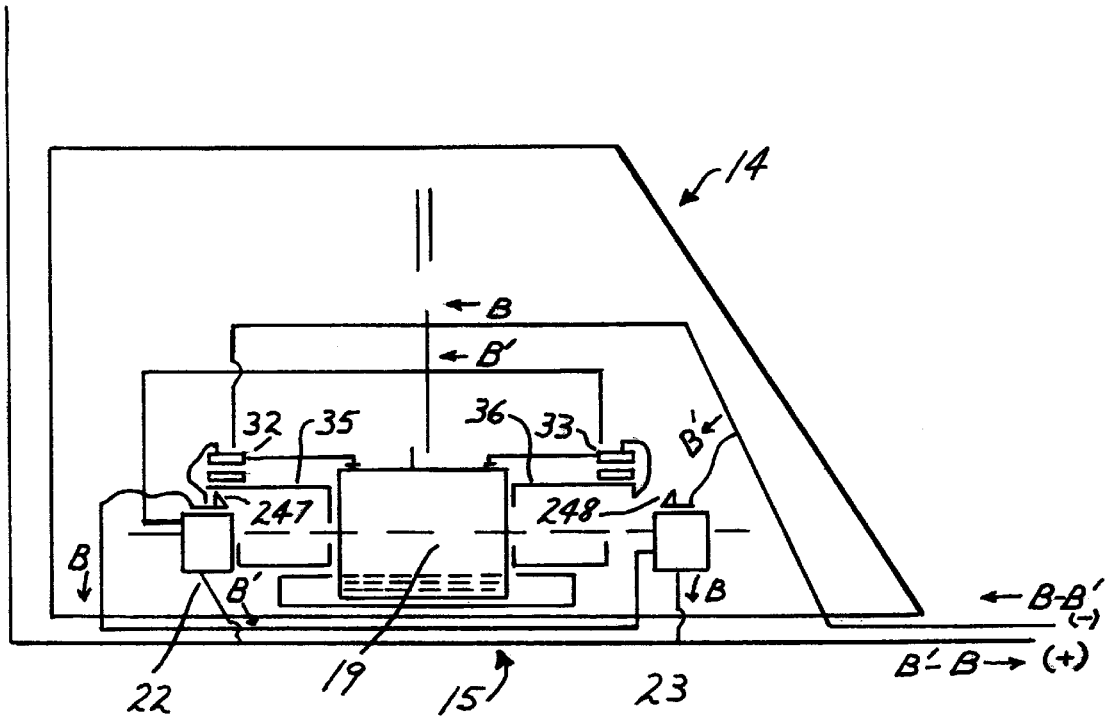
FIG. 12 is a circuit trace of the invention's provision for reversing the direction of a tone producing assembly's damped reed/plectrum shuttle mechanism.

4) Shuttle body 19 left side travel limit bracket 29, is fastened to the body's left side, while travel limit bracket 30, is fastened to the body's right side.

c. Provide circuit apparatus for reversing the travel of the shuttle body 19, so that its operation would be charachterized as a "rapid thrusting back and forth motion". (see FIG. 12)

1) The shuttle body 19 carries two probe 31 supported, lift electromagnets 32 and 33. Each probe 31 is fastened to a support angle bracket 34, that is fastened to the top of the shuttle body 19.

2) The shuttle body 19 also carries two flexible contact arms 35 and 36. The contact arms 35 and 36, are fastened to the body 19 so that each extends outward from the body 19 in parallel alignment with and spaced below its corresponding probe 31 supported electromagnet 32 and 33. Two circuit continuation contacts, 247 and 248, are provided. 247 is carried atop electromagnet 22, and 248 is carried atop electromagnet 23. These contacts facilitate reversing the directional pull on the shuttle mechanism's 15 shuttle body 19. (see FIG. 12)

d. Provide each assembly 13 with tone producing apparatus.

1) An assembly reed 16, while made of steel, is capable of producing a specific tone when it is plucked. Each assembly frame 14 carries a reed 16. The reed 16 is held by an anchor post 37. The post 37 is fastened to the underside of the frame's 14 top horizontal member 38. The post 37 is hollow and could be part of the frame 14 casting. A reed clamp 39, supports the reed 16 to the post. A reed clamp 39 consists of two concentric spaced apart rings, 40 and 41, that are joined by an elongated arm 42. Each ring 40 and 41, is provided with a set screw 43. The top ring 40 is fastened to the lower end of the anchor post 37. The bottom ring 41 is fastened to the upper end of the reed 16.

Figure 2:
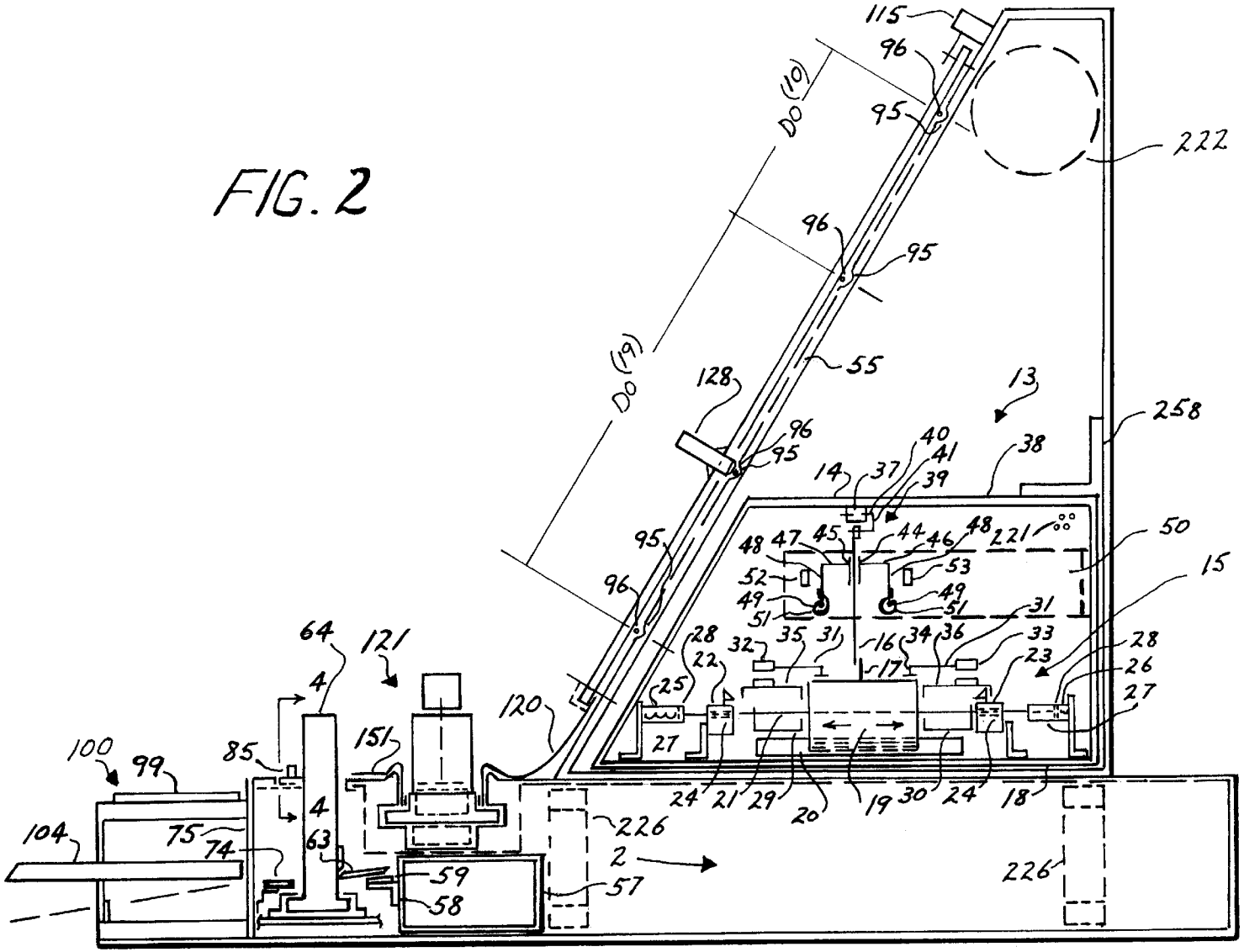
FIG. 2 is a side elevation view of the invention that shows tone producing apparatus, tone accessing apparatus, and keyboard apparatus, and the instrument's single tap key.

2) Each assembly frame 14 carries reed damping apparatus. Two damping shoes 44 and 45, are each supported to an attitude of being in moveable contact with the musical tone producing reed 16, by a corresponding reed damp shoe lever support arm 46 and 47. The vertical member 48, of each arm is flat and magnetically responsive. Shoe 44 is carried by arm 46. Shoe 45 is carried by arm 47. Each arm, 46 and 47, is stabelized/supported on a pin 49, to an attitude spaced out from the near vertical surface of the damping apparatus bracket 50. (cont. ref. to FIG. 2) Each arm's pin 49 fastening includes a return spring 51, that keeps the arm 46 and 47, in contact with the reed 16. Two damping electromagnets 52 and 53 are fastened, spaced out, blocking not shown, from bracket 50, positioned as shown in FIG. 2. On actuation of the shuttle mechanism 15, magnets 52 and 53 become magnetized, and attract arms 46 and 47, to remove the shoes, 44 and 45 from contact with the reed 16.

Note 1:

1) Shoe 44 and 45 removal from contact with a reed 16, occurs each time the shuttle body 19 is moved horizontally.

2) It is intended that the damping shoes 44 and 45, are to be lifted from their damping attitude almost simultaneously with, but before the plectrum 17 plucks the reed 16. It is anticipated that varying the factors that influence the comparative rate of speed of the plectrum 17 and arms 46 and 47 will govern timing an assembly 13.

C. A chromatic musical tone group accessing system (see FIGS. 3, 4, 5, and 6)

a) Provide system apparatus for accessing a given 29 successive chromatic musical assembly tones group to 29 exposed conducting wires 96 in the instrument face, so that these 29 tones can be used individually to play a given musical tune. (Refer to Invention Circuit FIG. 11)

1) An accessing system elongated individual assembly circuit contact plate 56, is supported to an elongated rectangular structural shape 57, by support bracket 58. The plate 56 is fastened to the top surface of a trapezoidal shaped base 59 that is carried by the bracket 58. The plate surface slopes down from the structural shape 57. A circuit wire 60 from each of the 88 tone producing assemblies 13, is connected to a corresponding contact 61 on the plate 56. A travel stop bar 62 that is required for a complementing system element, the leaf, 63, (see below), is provided at each end of the contact plate 56. (see FIG. 5)

2) An accessing system slideable rectangular shaped body 64 that has extensions 65 along its sides, so that it resembles an inverted T, is carried in a modified U shaped slideway 66, (see FIG. 3) that extends the full width of the instrument 1. The body 64 carries a leaf 63 that is hinge 67 fastened to the side of the body. (see FIG. 6) The leaf 63 carries 29 elongated conducting contacts 68 that are fastened in parallel array along the underside of the leaf 63. The contacts 68 project out from the hinge's pin 69. A horizontal wire access hole 70 through the body 64, is provided for each of the 29 contacts 68. (Refer again to FIG. 3 and FIG. 6) A Contact plate 71 that has 29 contacts 72 that correspond to the 29 leaf contacts 68, is fastened horizontally above the access holes 70 alignment, on the body 64 side opposite the leaf 63. The hinge pin 69 carries a tension spring 73 that provides downward pressure by the leaf 63 on the contact surface of plate 56.

3) A stationary contact plate 74, is supported to a vertical member 75 of the rectangular base 2 by bracket 76. The plate 74 is centered between the instrument 1 sides. A circuit wire 77 from each of the 29 leaf contacts 68 is extended through a corresponding access hole 70, and connected to the corresponding contact 72 on plate 71. Loosely hung wires 78, one from each of the 29 72 contacts, is connected to a corresponding contact 79 on plate 74. (cont. to refer to FIG. 3)

Figure 7:
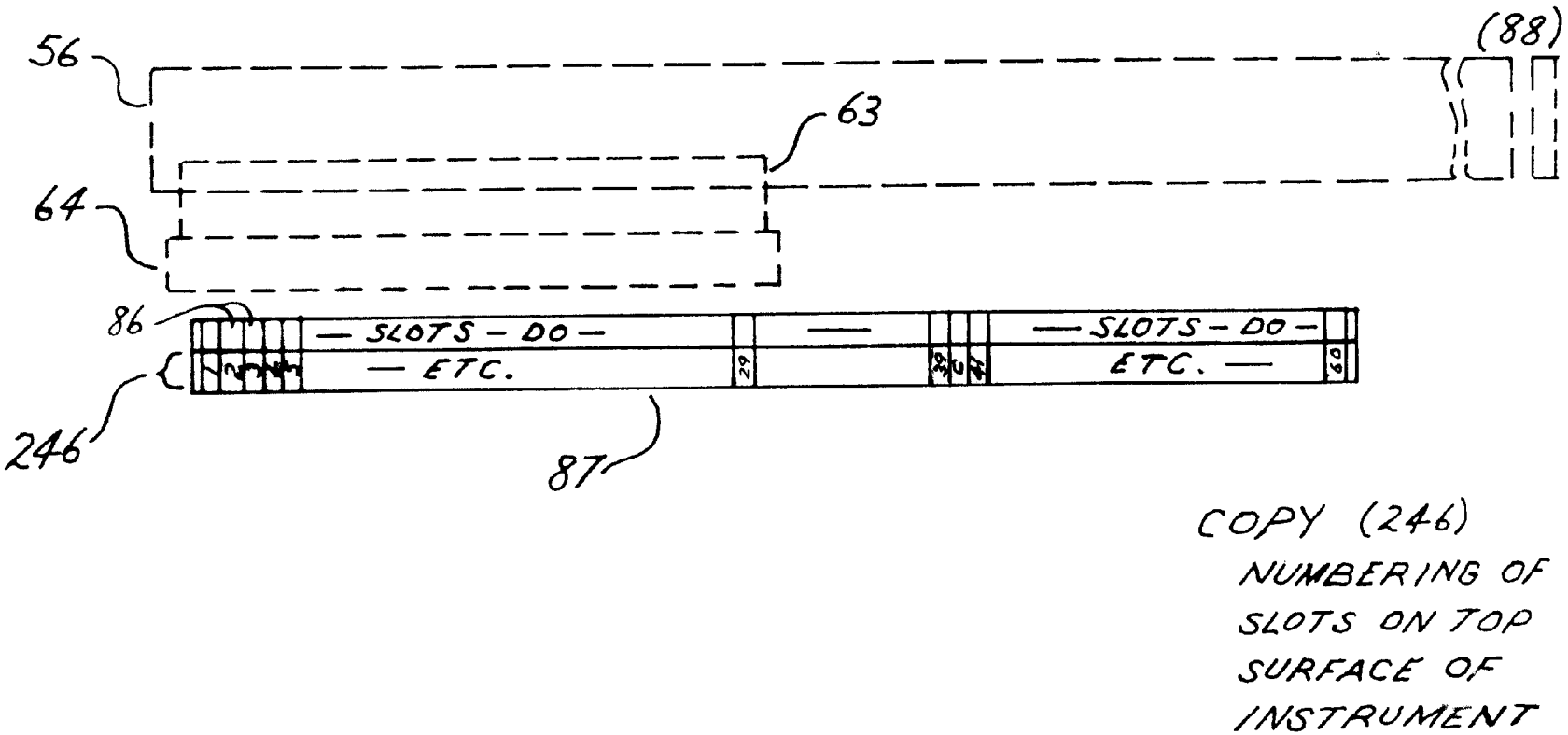
FIG. 7 shows the copy that is to be printed on the instrument's top surface along and adjacent the tone group accessing stabelizing holding bar for reference in composing.
Figure 8:
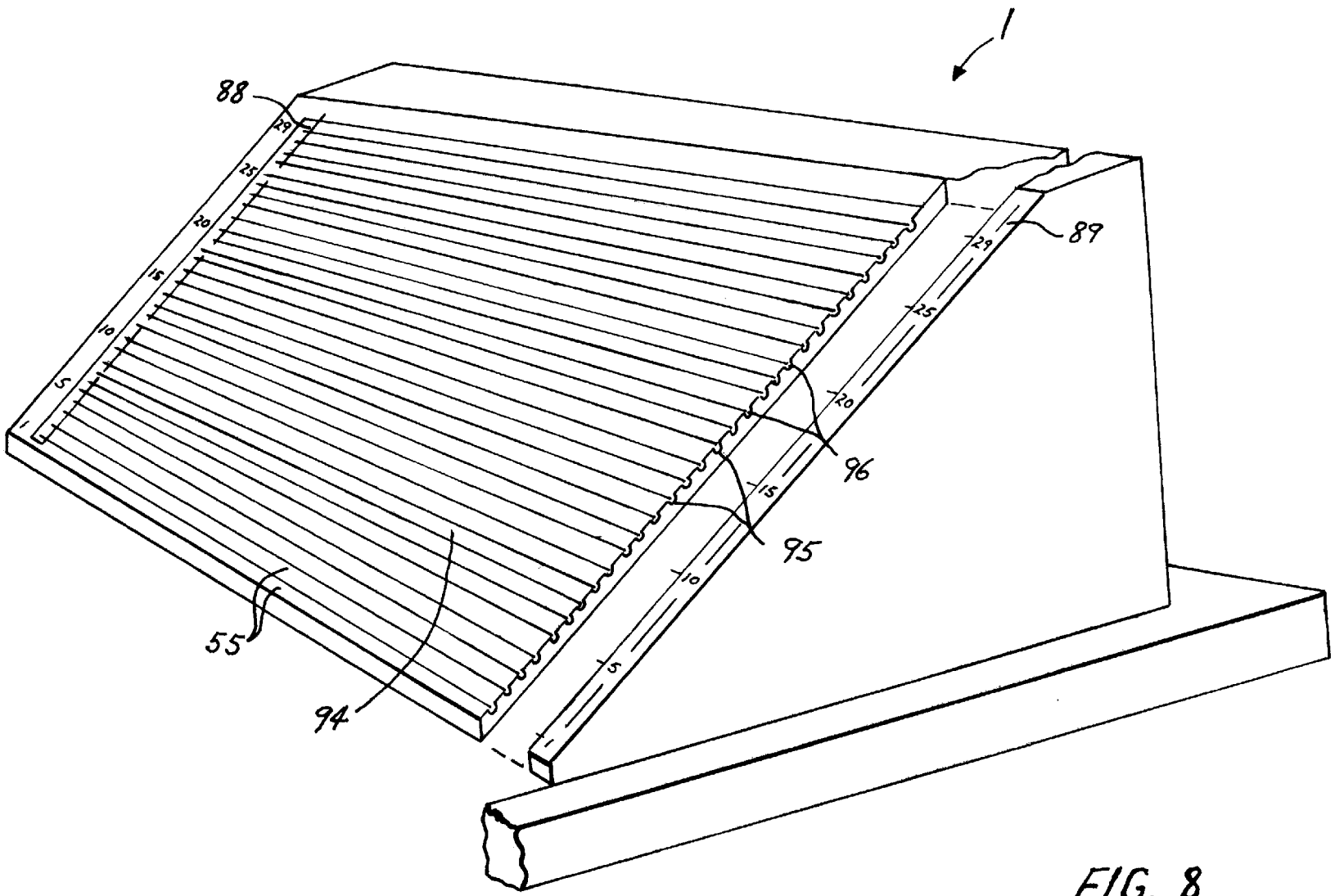
FIG. 8 is a perspective view of the tune network base—29 tone conductors—built into the face of the instrument.

4) The accessing system body 64 is provided with a hand operated stabelizing mechanism 80. (Refer again to FIG. 4) A mechanism 80 L shaped locking lever 81 is hinge 82 fastened to the side of the body 64. The hinge pin 83 is horizontally disposed in its fastening and carries a tension spring 84 that provides counter clockwise pressure on the lever 81, so that the lever's horizontal member, which carries a vertical tab 85, will cause the tab to be seated in one of 60 vertical slots 86 cut in an elongated holding bar 87 fastened to the top surface of the instrument 1. The elongated holding bar 87, carries copy 246, as shown in FIG. 7. The letter C is displayed adjacent slot 40. It is used as a reference mark to assist in conceptual placement, scale wise, of the 29 musical tones that are being accessed. The remainder of the copy identifies slots 1 to 39, and 41 to 60. The vertical tab 85 corresponds to musical tone #1 of the 29 accessed tones. A reference line marker 242 is printed above the tab 85. C corresponds to the assembly 13 that produces a "middle C" tone. See FIG. 4 Locking lever 81 is flexibly connected to displacement lever 92. A rod 249 is crimped and hinged in a hole 251 at the top of 81's vertical member and connected to hinge 252 mounted on the back of 92. Spring 84 keeps counterclockwise pressure on lever 81, and keeps tab 85 seated in a slot 86. Lever 92 is hinge 250 fastened at the top of body 64. When lever 92 is depressed, 81 is displaced, and tab 85 disengages from the slot 86 it is seated in, and the body can then be slid back and forth in the slideway 66. (see FIG. 3) The #1 tone is sought and identified. The vertical member 92 is released so the vertical tab 85 seats in the tone slot 86. And thusly, 29 chromatic tone circuits are accessed to the instrument face 55. The 29 tone circuits carried in the face become identified by the numbers 1 to 29 printed at the left on the instrument face 55. Two accessing system tune circuit contact plates, 88 and 89, are fastened to the instrument face 55. (see FIG. 8 and FIG. 11) Each plate carries 29 contacts that are in corresponding horizontal alignment, from plate to plate. The plates are parallel amd extend from the bottom to the top of the face 55. Plates 88 and 89 carry contacts 90 and 91 and are disposed on the left side and right side of the instrument face 55, respectively. A circuit wire 93 from each of stationary contact plate 74's 29 contacts is connected to a corresponding contact 90 on plate 88.

6) An accessing system tune network base 94 is provided. 29 semicircular grooves 95 are cut into the surface of the instrument face 55. (see FIG. 8) The grooves 95 run horizontally and are parallel to the top and bottom edges of the face 55. Each groove 95 carries a solid bare conducting wire 96. In its placement, ½ of the wire's diameter is set in a groove 95, and the other ½ of the wire's diameter extends above the surface of the face 55. The base 94 compliment, designated a tune board 971, to be specified, will be placed over the base, to constitute a tune network 98. Each conductor wire 96 is a connector between a corresponding set of 90 and 91, contacts.

Note 2:

1) An accessing system tune network reader, a 29 key 99 keyboard 100 is to be specified. (see FIG. 1) The keyboard 100 is not used to play a tune on the instrument 1. It is intended as a means of identifying the tone sounds that are accessed.

2) The keyboard 100 keys are placed in correspondence with the 29 conductor wires 96 in the tune network base 94 in the face 55 of the instrument by providing a circuit wire 101 to connect each key 99 on the keyboard 100 to a corresponding face 55 contact 91 on plate 89. (see FIG. 11)

3) Also in connection with accessing, tone contacts 128, that can be moved by hand into a composed tune configuration on a composing type tune board 972 will be specified.

Figure 10:
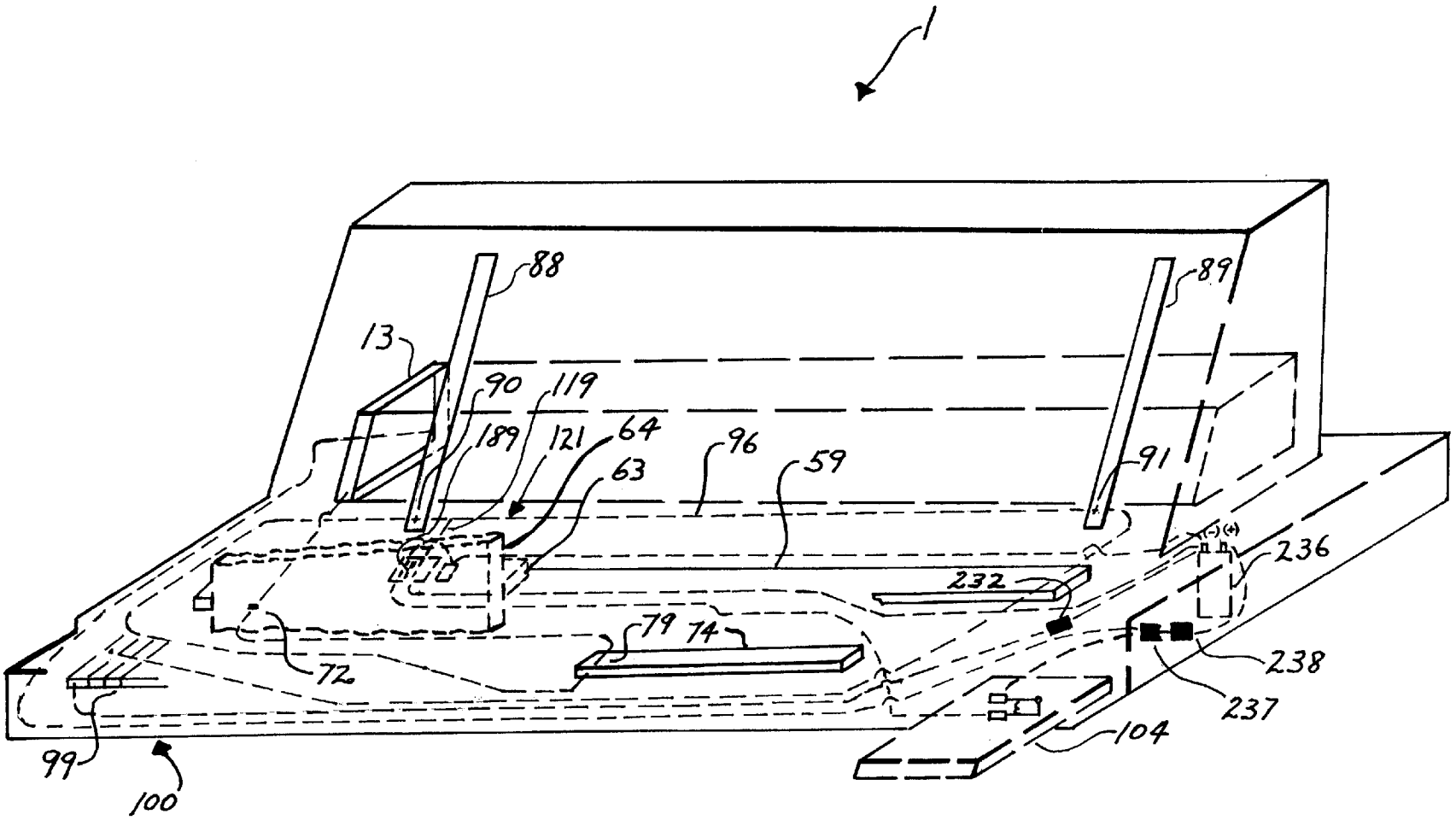
FIG. 10 is a simulated typical circuit for actuating a tone producing assembly by a keyboard key or by the instrument's tap key.

4) FIG. 10, a simulated typical circuit employed in actuating tone producing assemblies, either by keyboard key 99, or by use of an instrument tap key 104, provides insight into the operation of the accessing system.

Figures 13, 14:
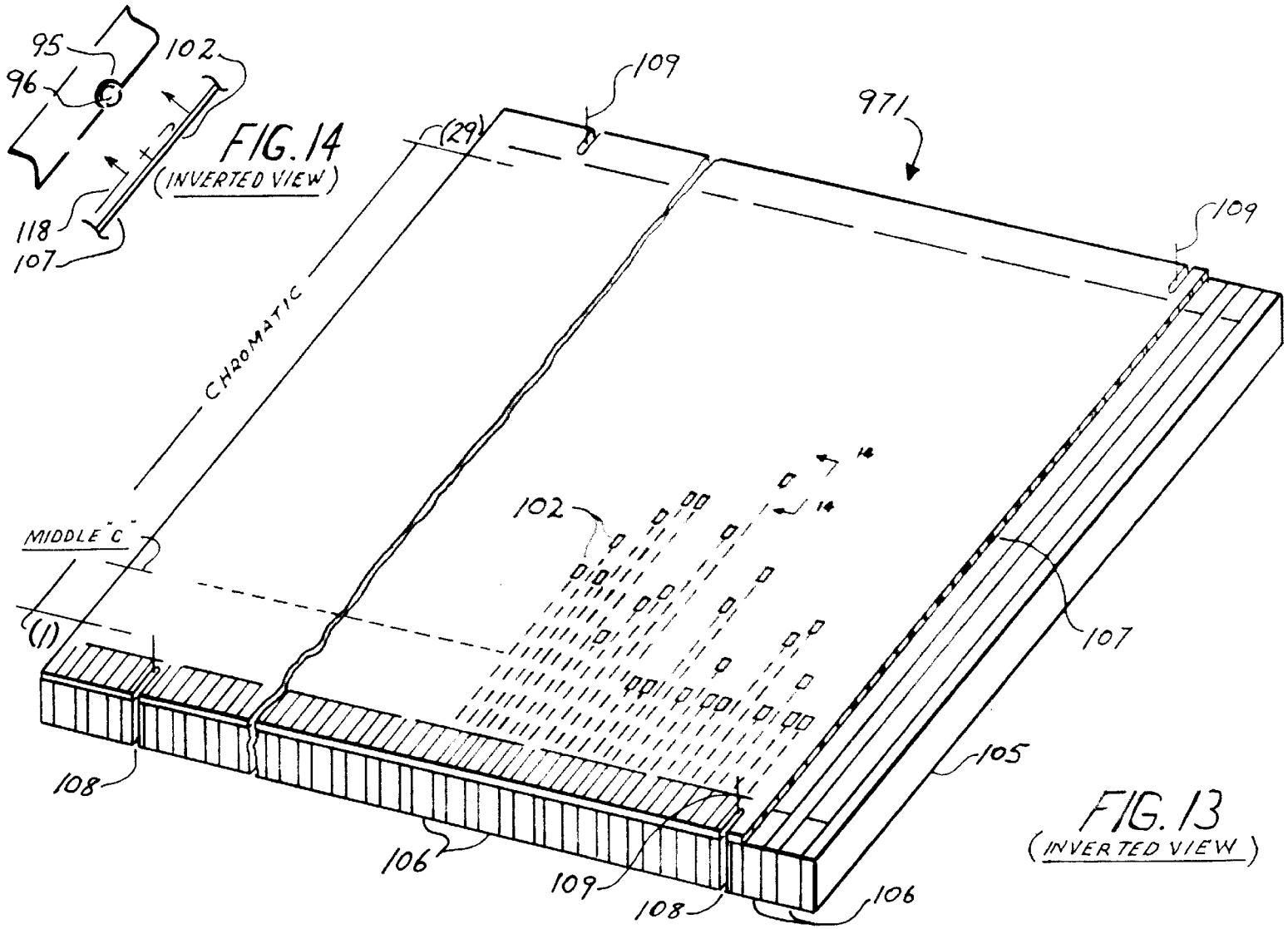
FIG. 13 is a perspective view of the bottom side of a tune board that is manufactured with a plurality of fixed tune circuit contacts that are pre-set in a "tune configuration" that can be played on the instrument.
FIG. 14 is an enlarged side elevation of a fixed tune circuit contact as shown in FIG. 13.

D. A tune board circuit assembly contacting system (see FIG. 13)

a. Provide system apparatus for deploying in a configuration, a plurality of contacts that can be switched on and off, one at a time, by tapping a single key, to effect specific tones in a sequence that constitures a given musical tune.

1) Provide a structurally framed tune board 971, comprised of a plurality of parallel ribs 105 that are equally spaced apart and joined at their ends by spacer plates 106. Provide a tune board 971 base sheet 107, that covers and is fastened to the bottom surface of the rib 105 framing. The ribs 105, plates 106, and base sheet 107, could be fastened by gluing. Provide 4 corner slots 108 in the board 971, oriented in a top of board to bottom of board direction. Provide, as complimentary to the tune board slots 108, 4 alignment pins 109, that are set in the face 55 of the instrument 1. The pins are a locating guide in placing the board 971 on the instrument face 55. (Refer again to FIG. 1) A typical tune board 971 fastening to the face 55 of the instrument 1 is as follows. The bottom horizontal side 110 of the board 971 is placed under the raised edge of two Z brackets 111 that are fastened, spaced apart, along the bottom of the instrument face 55. The top horizontal side 112 of the board 971 is engaged and held by a pair of flaps 113, that are mounted on a rotateable rod 114. The flaps 113 could be made of clear plastic. The rod 114 is carried by a pair of sleeves 115 that are fastened along the top of the instrument face 55. The rod 114 end carries a lightly weighted handle 116, which can be used to rotate the rod so that its flaps 113 move against or away from the exposed surface of the board 971. The rod assembly 114 serves to hold the tune board 971 in a fixed alignment with the instrument's tune network base 94.

Figure 15:
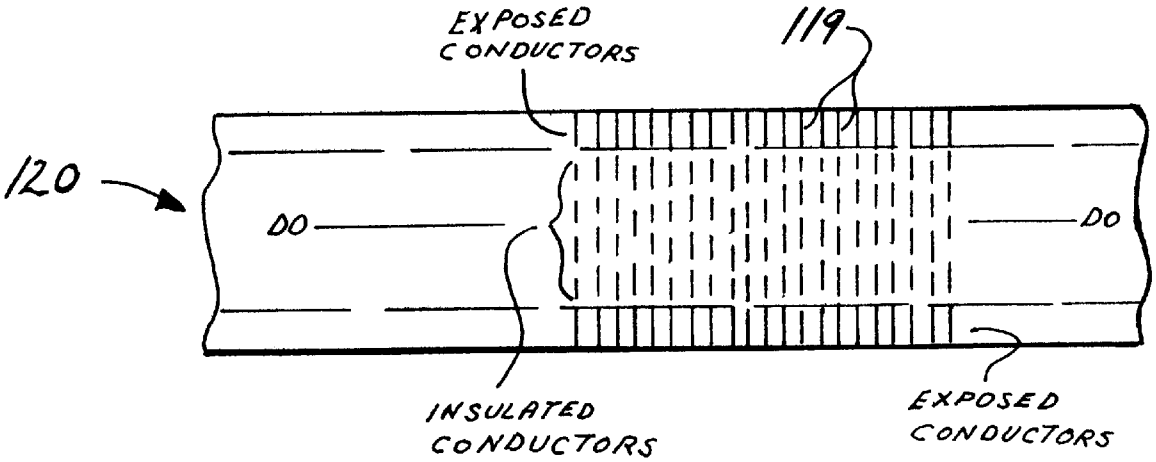
FIG. 15 is a top view of a simulated tune circuit conductor line extension sheet.

2) Provide a plurality of resiliant contacts 102 fastened in a specific configuration to the unfastened side of the tune board 971 base sheet 107. (Refer again to FIG. 13, and see FIG. 14) A manufactured tune board 971 provides one of several possible tune contact configurations. The contact 102 could be made of spring steel. The contact 102 has a conducting surface coating. The contact 102 could be fastened by rivet. An insulated conducting line 118 is connected to each contact 102 and extends from the contact to the bottom horizontal side of the tune board 971. (Refer again to FIG. 3, and see FIG. 15) The line 118 could be applied to the surface of the base sheet 107 by a screen process where a first printing would apply a conducting material, and a second overprinting would apply a non-conducting material. The ends of the conducting lines 118 , are exposed conducting surfaces. Placement of the tune board 971 on the instrument face 55 provides superimposing each line 118 end on a corresponding tune circuit extension line 119 A plurality of exposed circuit extension lines 119 are carried on a rectangular, plyable, extension line sheet, 120. The sheet 120 is fastened to the face 55 and top surface of the instrument's rectangular enclosure 2. The sheet 120 lines 119 provide circuit continuation from the tune network base 94 to the circuit switching mechanism 121, that is to be specified.

Figure 17:
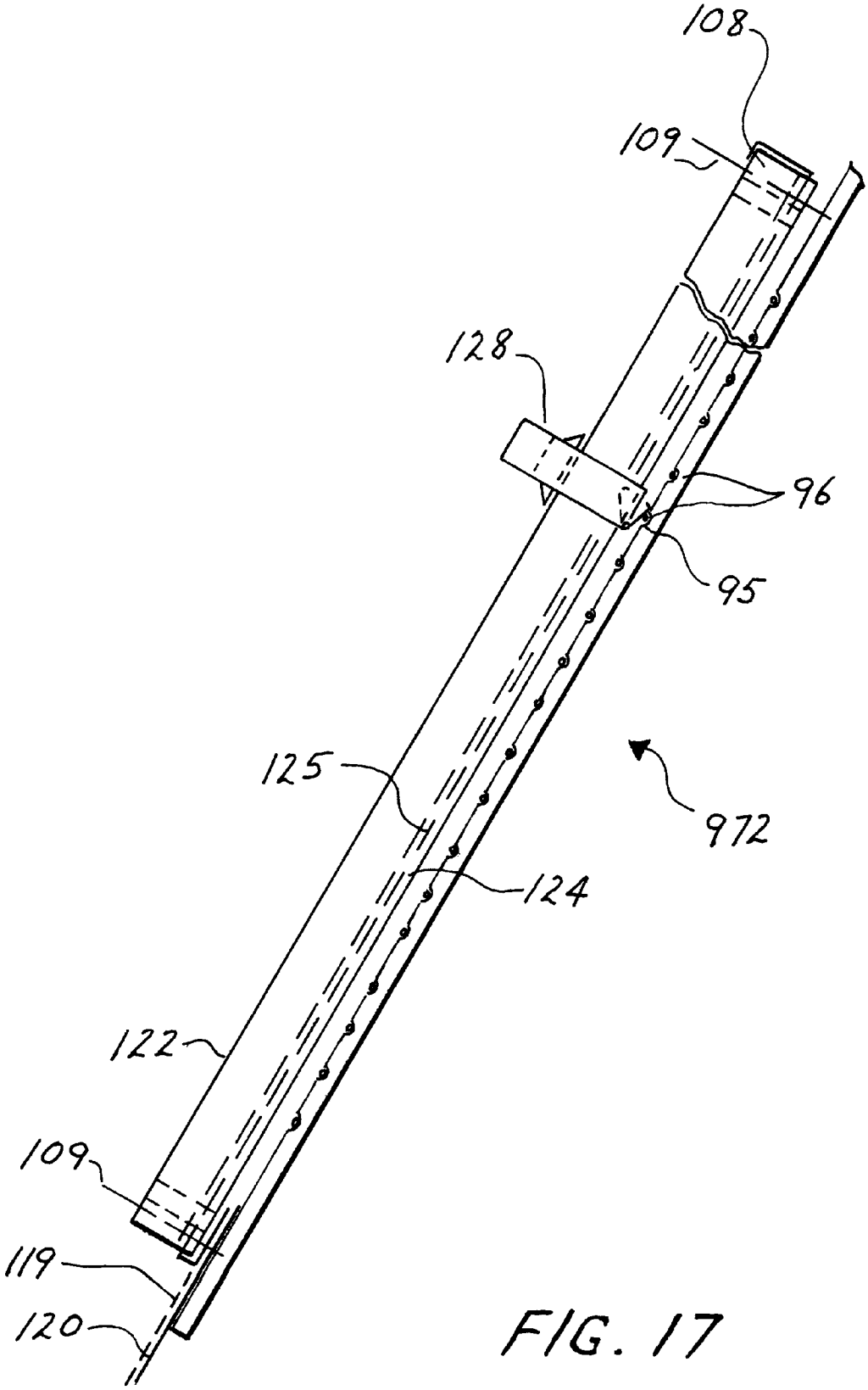
FIG. 17 is a side elevation view of a tune board that carries a plurality of moveable tune circuit contacts that can be moved into a "tune configuration" that can be played on the instrument of the invention.

3) Provide a tune board 972, that is intended for use in composing a tune, and playing it on the instrument 1. (see FIG. 17) Provide a structurally framed board 972, comprised of a plurality of parallel ribs 122, that are equally spaced apart and joined at their ends by rectangular spacing plates 123. Each composing tune board 972 rib 122, has a slot 124 that extends the full length of the rib 122. (Cont ref. to FIG. 17, and see FIGS. 18, 19, and 20) The rib 122 resembles a modified, inverted U. The rib slot 124 carries a conducting rod 125, fastened to the top interior horizontal surface of the slot. Each conducting rod 125 extends from the top end to the bottom end of the board 972. Each rod 125 is wrapped around and folded under the lower end and over the upper end of the rib 122 it is carried in. A filler piece 126, not shown, is proveded in the slot 124, to support the rod 125 in its fastening. When the board 972 is placed on the instrument face 55, the folded under rod 125 ends become superimposed on a corresponding extension line sheet 120 tune circuit extension line 119. The 972 composers tune board carries 4 corner slots 108 that are compatable with the alignment pins 109 provided for the 971 tune board. Fastening the 972 tune board to the instrument face 55, would be as specified for fastening the 971 tune board. Provide each rib 122 of the composing tune board 972, with one or more slideable contact bodies 128. In composing, more than one contact body can be deployed on each rib 122 in making a tune configuration. The contacts 128 are disposed along the top of the tune board 972, until they are moved to a selected position on the board. (cont. ref. to FIGS. 18, 19, and 20)

4) In constructing a slideable contact 128, provide two side pieces, 129 and 130, that are joined by a flat center piece 131, to form the contact body 128. Fasten these 3 members by thru bolts and nuts 132. Provide the body 128 with a flexible compressible conductor 133. The conductor 133 is carried on a body thrubolt 132, and is disposed with its top curved arm 134, compressed against the bottom surface of the conducting rod 125, while its bottom notched arm 135 engages either the face of the instrument 1, or one of the 29 horizontal tune wires 96, carried by the instrument face 55.

5) (referring back to FIGS. 13, and 17) The resiliant contact lines 118, and the moveable contact 128 rods 125, have identical near vertical spacing. Either tune board, 971 or 972, therefore, is compatable with the spacing of the tune circuit lines 119 carried on extension sheet 120. A plurality of contact lines 118 or contact rods 125 would be estimated to be 150 plus, to give the instrument sufficent tune capability.

Figure 3:
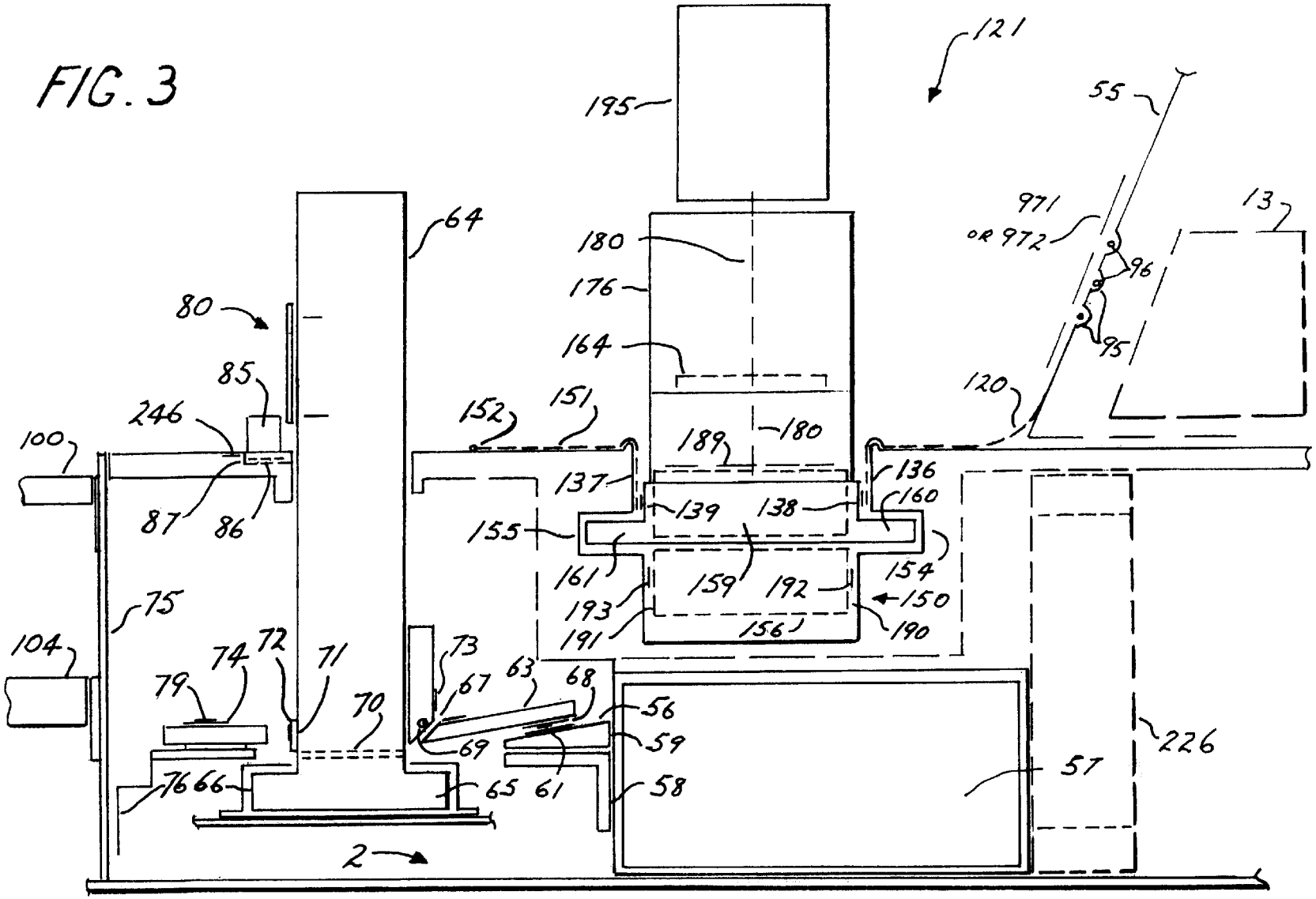
FIG. 3 is an enlarged sectional view of the instrument's mechanical tone assembly accessing system apparatus that shows the system body carrying a contact bearing leaf selectively into alignment with an 88 assembly contact plate.
Figure 6:
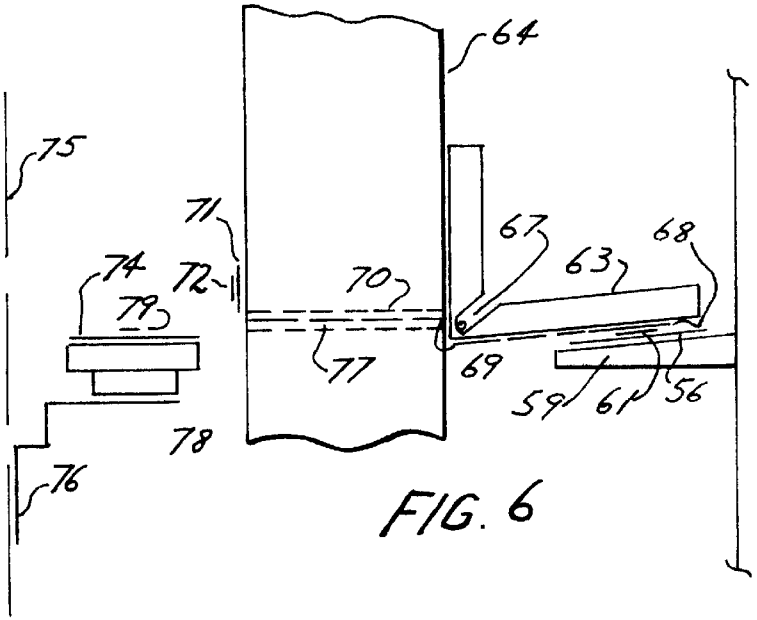
FIG. 6 is an enlarged view of the instrument's 29 tone contact group sliding leaf embodiment.
Figure 4:
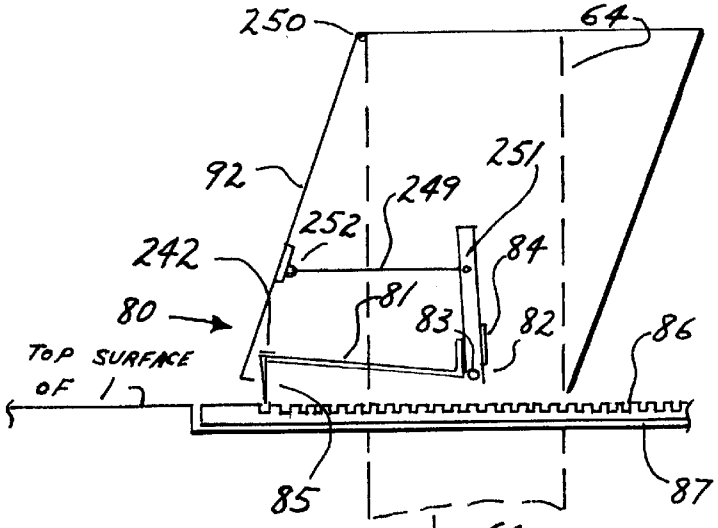
FIG. 4 is an enlarged side elevation view of the instrument's tone group accessing stabelizing apparatus.
Figure 5:
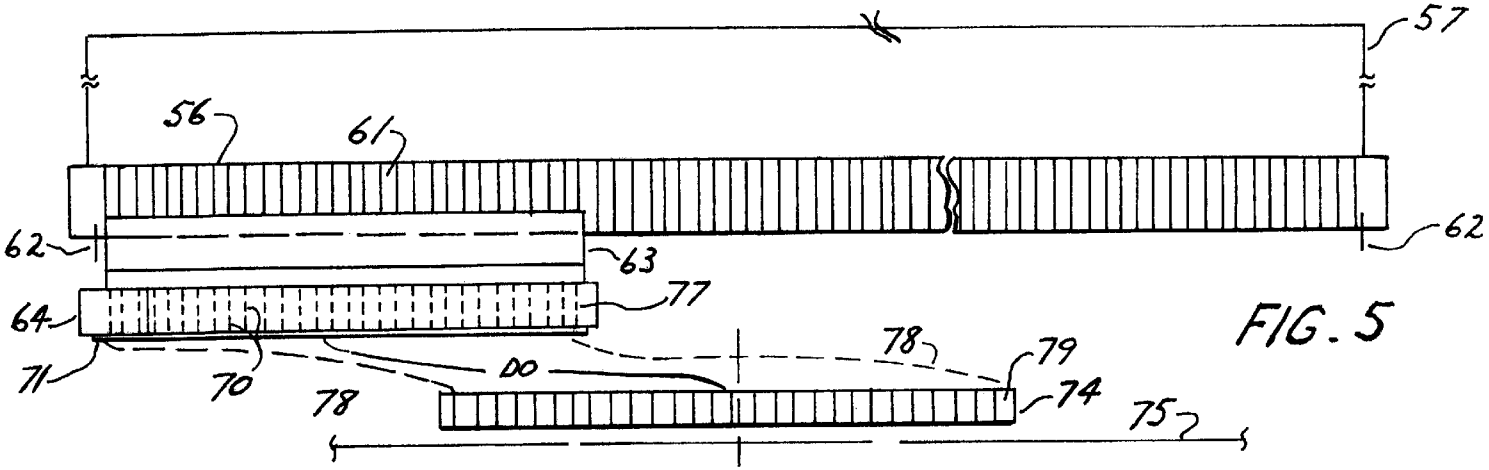
FIG. 5 is a top view of the instrument's tone group accessing apparatus that shows 29 tone circuits being accessed from an 88 tone assembly circuit plate.

6) Note in FIG. 2 and in FIG. 3 that provision is made for extending the lower horizontal edge of the extension sheet 120 vertically down and fastened to the upper vertical face of one of the instrument's track and bridged circuit facings, 136 and 137. The 120 sheet could be fastened by gluing. The lower vertical edge of the sheet 120, carries each tune circuit line 119. Each tune circuit line 119, extends to and is connected electrically to stationary contact 138 on track 150 face 136.

Figure 16:
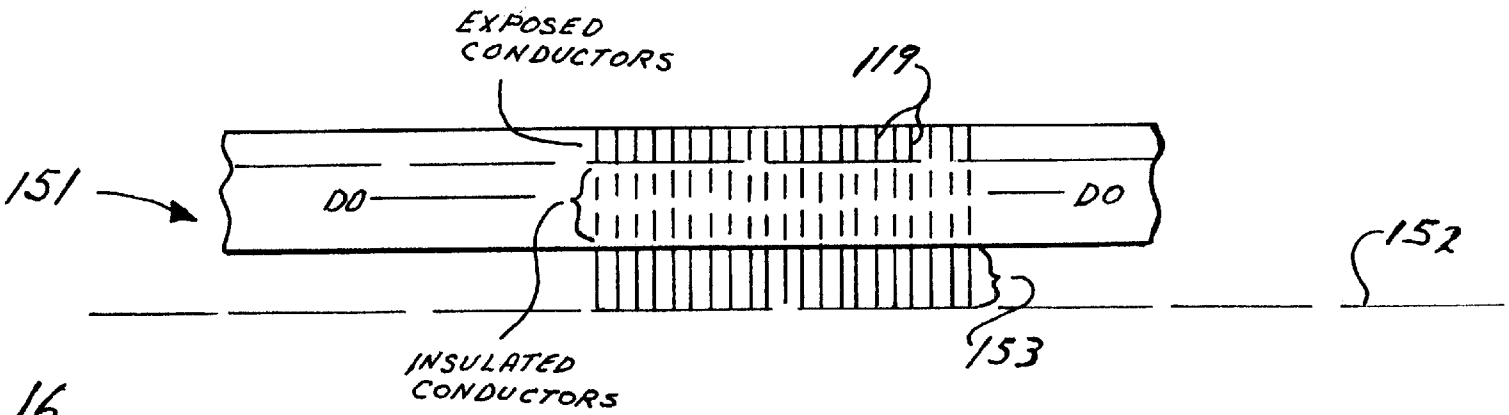
FIG. 16 is a top view of a compliment to the FIG. 15 extension sheet.

7) Note in FIG. 16 that provision is made for continuation of the 119 circuit lines carried on sheet 120, on a complementary sheet, 151. Sheet 151 is fastened on track 150 vertical side face 137. Hex shaped contact 139, which corresponds to contact 138, is stationarily fastened to the 137 vertical face opposite the 136 face. The 151 sheet carries 119 lines that correspond to the 120 sheet lines on the opposite side of the trackway 150. The 151 sheet 119 lines extend electrically from each 139 hex contact vertically up the facing 137, and then a nominal horizontal distance, to a common wire 152. Hex contacts 138 and 139 are exposed contact surfaces. Circuit switching mechanism 121, bridges circuit faces 136 and 137, as it travels track 150, the width of the instrument 1. (cont. ref. to FIG. 16) The complimentary sheet 151 lines 119, which are conductors covered with a non-conducting coating, could be applied to the 151 sheet by screen process, applying first a conducting material and overprinting with a non-conducting material. The common wire 152, could merge at the sheet 151 edges, into an insulated copper connecting wire 153. The sheet 151 could be fastened by gluing. (refer again to FIG. 11)

Figure 9:
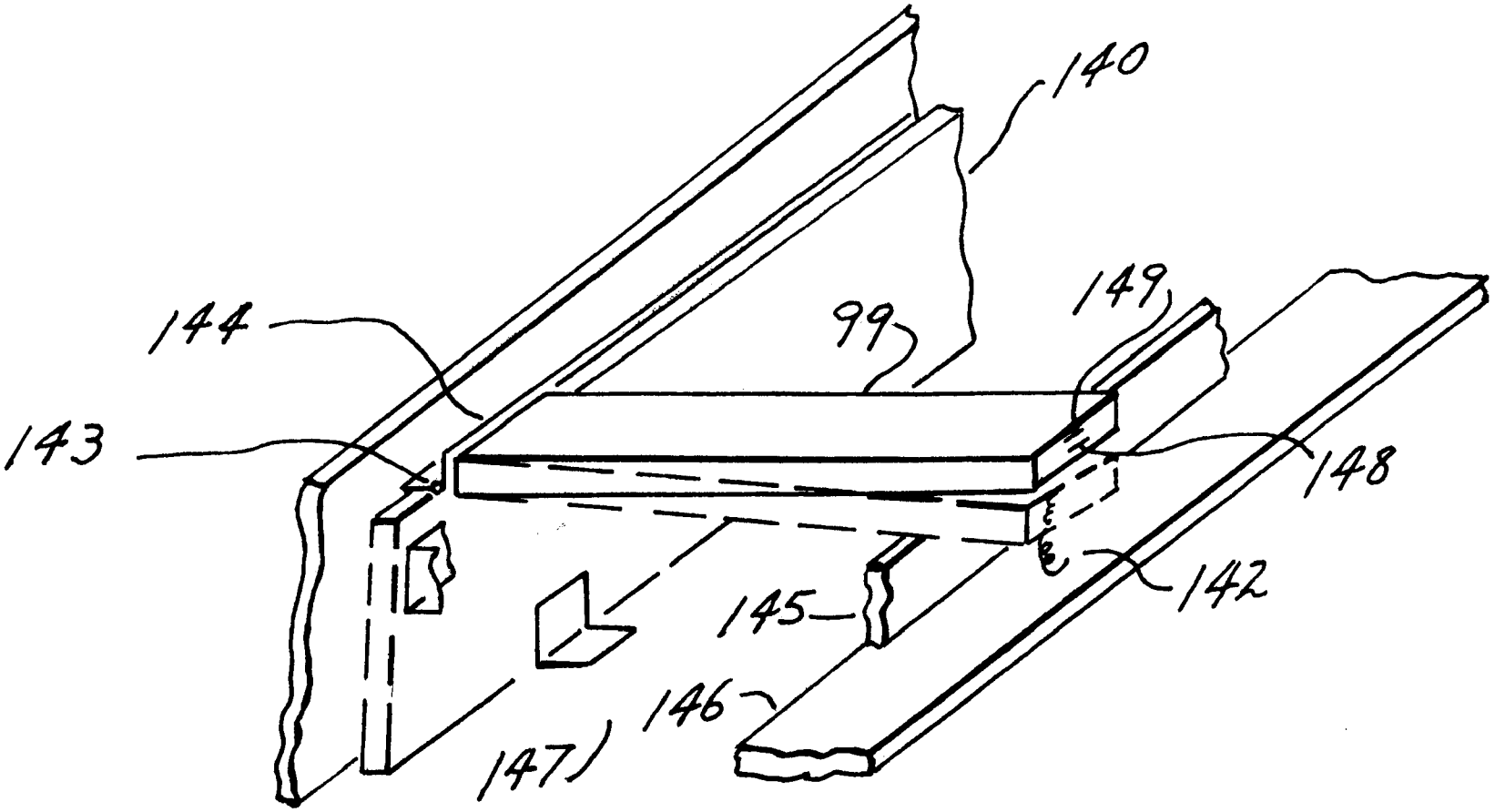
FIG. 9 is a perspective view showing the components of an instrument keyboard key.

E. Tone verifying apparatus for an instrument 1 composing system a) As a compliment to the specified 29 tone assembly 13 accessing apparatus, provide a keyboard means of actuating the sound producing assemblies. Provide the keyboard 100 with 29 white identical keys 99. Number the keys from left to right, 1 to 29. The key numbers correspond to the numbers 1 to 29 printed along the left edge of the instrument face 55 that identify the exposed conductors 96 of the network base 94. A key on the keyboard 100 is depressed, and the sound is listened to, when using the system. If the sound is acceptable, the line to the assembly that produces it is tapped by connecting a contact 128 to it, that connects it to a conductor rod 125. (refer again to FIGS. 1, 3, and 9)

1) In making the keyboard 100, fasten each key 99, to the top of a vertically supported hingeboard 140. The hingeboard 140 is supported to a vertical interior length member 75, of the rectangular base 2. Typically, provide each key 99 Of the keyboard 100, with a return spring 142, a hinge 143, and an elongated vertical-rise-limit angle 144. Provide the keyboard 100 with a down travel limit contact bar 145 that is supported to a base strip 146 that is fastened to the top surface of the base 2 bottom panel 147, and that extends under all of the keyboard 100 keys 99. Each keyboard key 99 is provided a set of contacts, 148 and 149.

Figure 21:
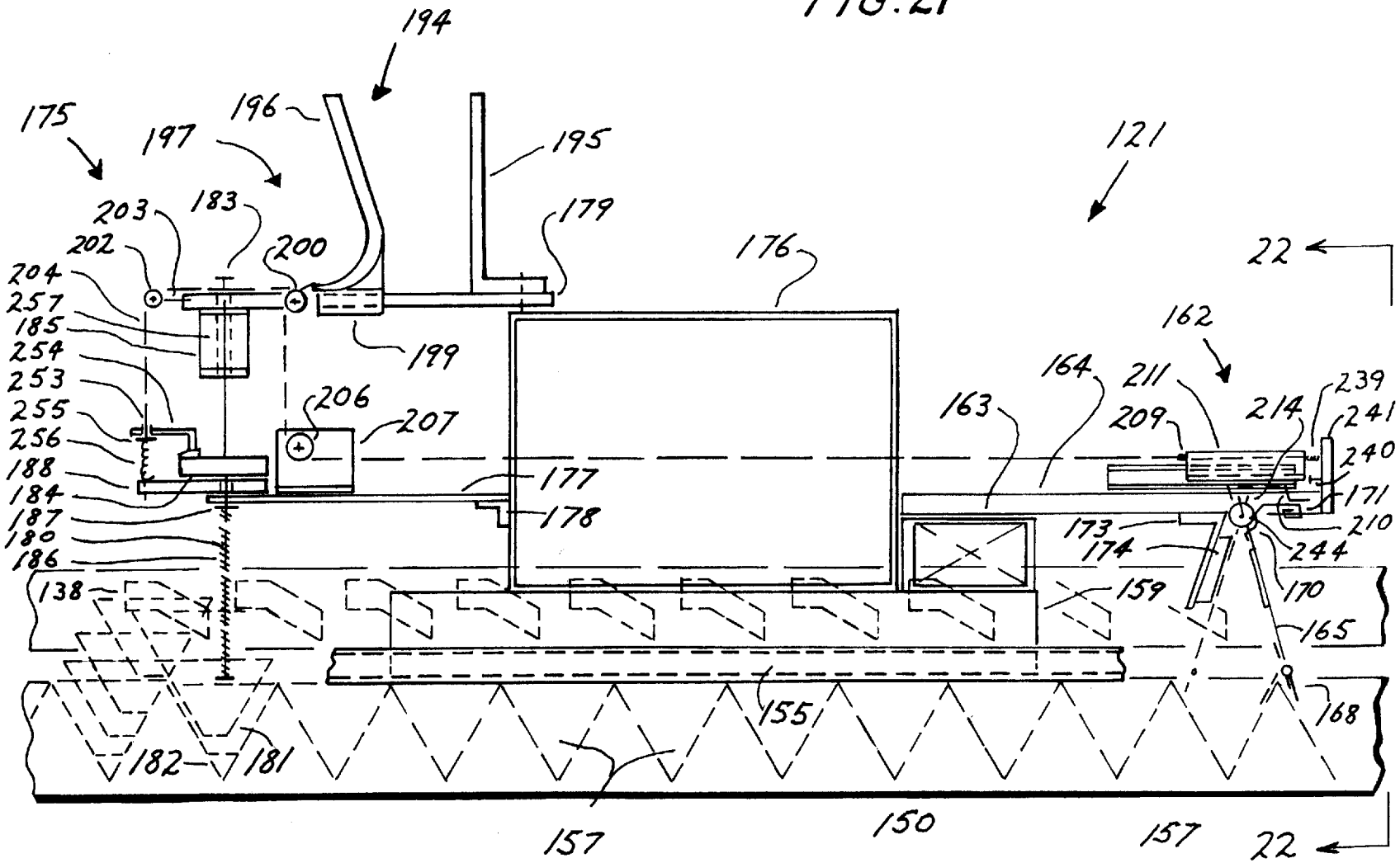
FIG. 21 is a side elevation view of a tune circuit switching mechanism that is guided in a trackway from open tune circuit, to open tune circuit, to switch them on and off, and generate a tune from a sequence of tones.

F. Apparatus for switching a plurality of tone providing assembly 13 circuits, on and off, one at a time, in given sequence. (cont. ref. to FIG. 3, and see FIG. 21)

a) Provide a circuit switching mechanism 121 that is propelled over an instrument trackway 150.

Figure 11:
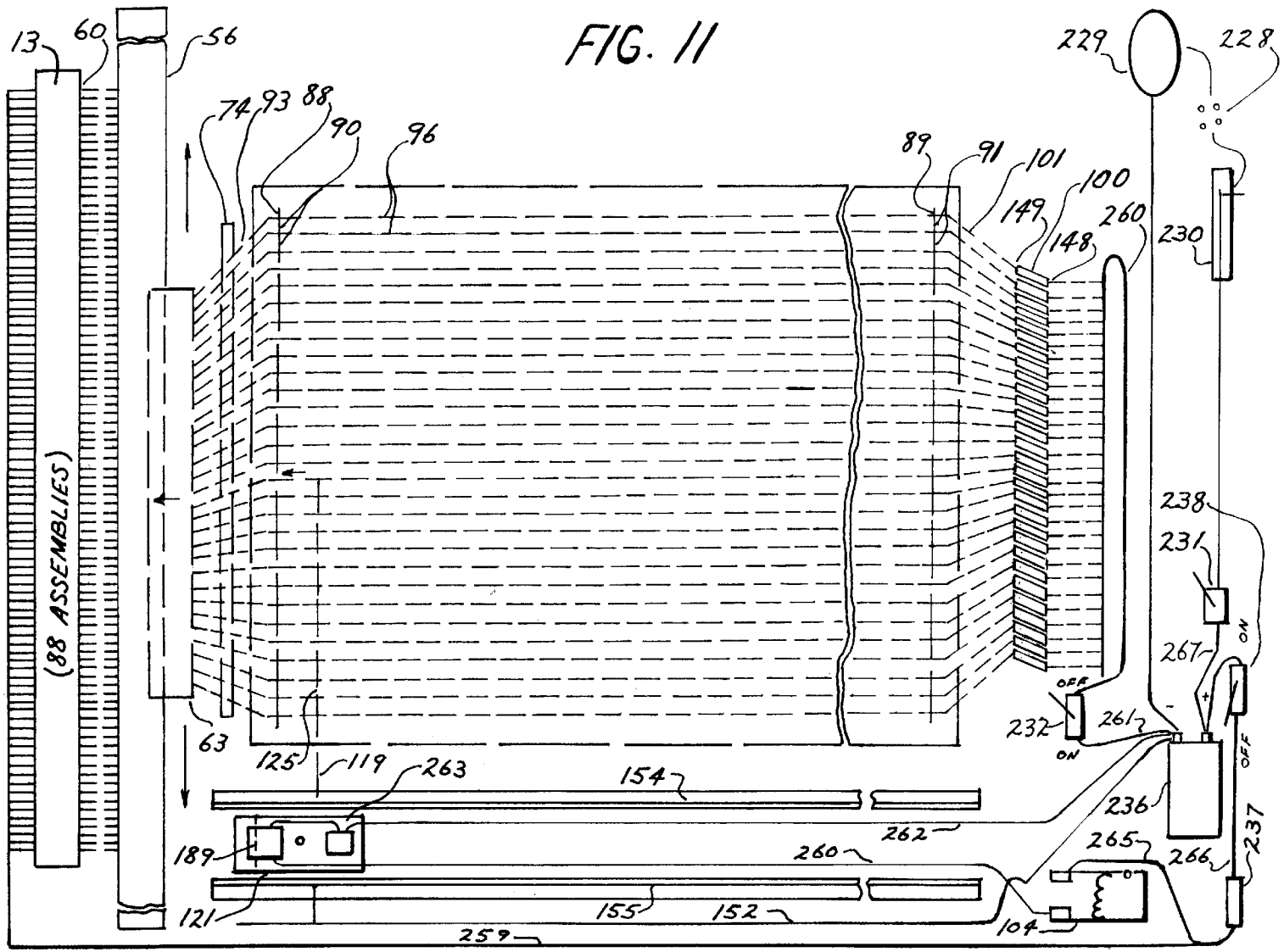
FIG. 11 is a circuit diagram for the invention.

Note 3:

See FIG. 11 and note that a battery 236 to assembly 13 circuit is open where the circuit encounters the switching mechanism 121. The switching mechanism, which is on its own circuit, and which carries a conductor line segment 189 across its top surface, provides conductor bridging of each of the open assembly circuits as it travels the trackway 150.

1) The trackway 150 could be a casting 156 made of plastic. Provide an elongated, unitized series of wedge recesses 157 that carries a channel trackway, 154 and 155, along each of its top edges. (see FIG. 3) The trackway unit 150 is carried by the box shaped structural member 57.

Figure 22:
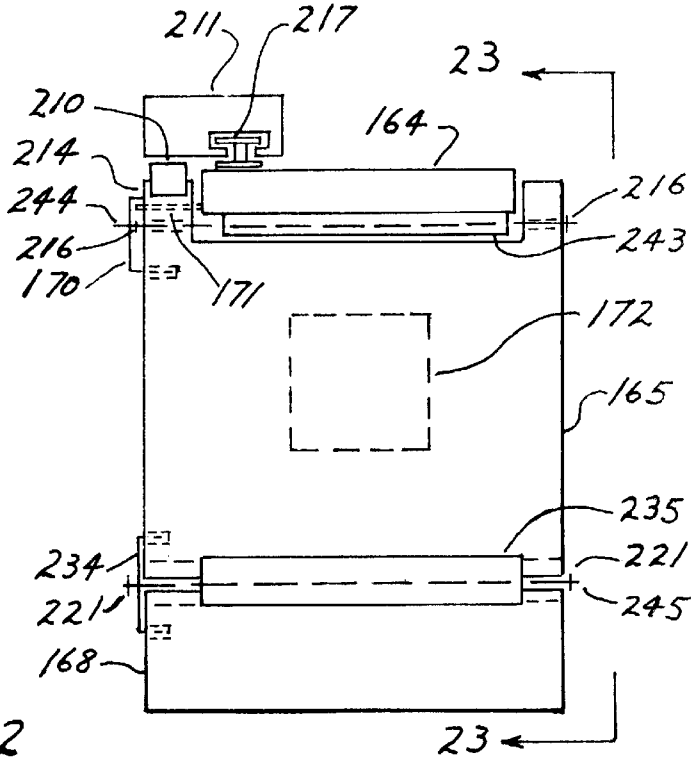
FIG. 22 is an enlarged front elevation view of the instrument's circuit switching mechanism pendulum propeller.
Figure 23:
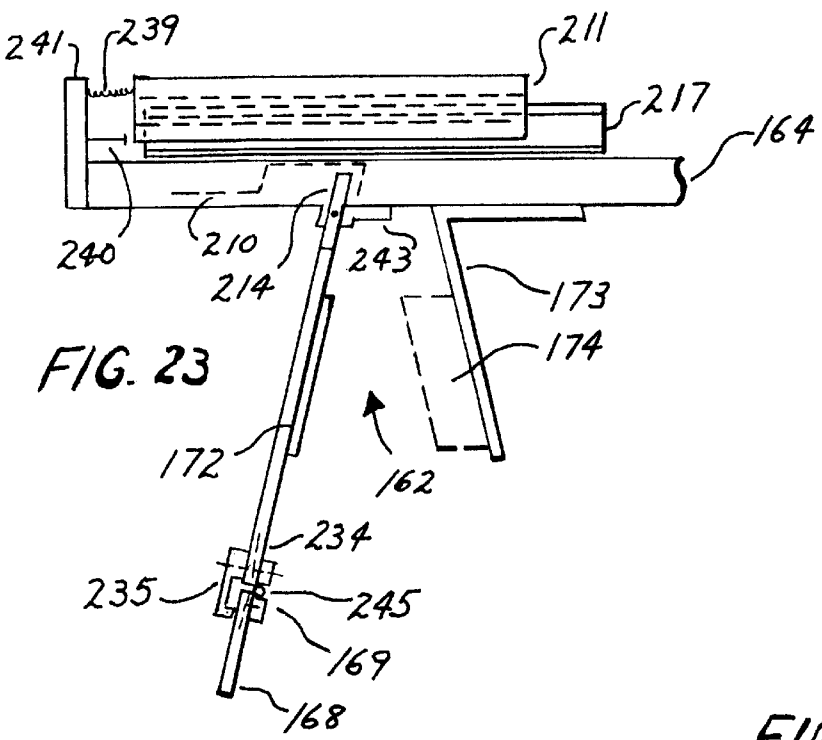
FIG. 23 is an enlarged side elevation view of the propelling pendulum shown in FIG. 22.

2) The switching mechanism 121 has a sled shaped base 159 that carries horizontally projecting runners, 160 and 161, along each side. The runners, 160 and 161, support the sled base 159 to the trackway channels 154 and 155 (cont ref. to FIG. 21, and see FIGS. 22, 23, and 24)

3) The mechanism 121 propulsion assembly 162 is supported to a base block 163 that is mounted on the front top surface of the sled base 159. A horizontally forward projecting arm 164, hinge 243 supports a pendulum shaped paddle 165. The paddle 165 is supported to the underside of the arm 164. The pin 244 of the paddle hinge 243 extends out of the sides of the paddle assembly. The pin 244 supports a spring 170 which maintains counter clockwise rotational tension on the paddle 165. One end of the spring 170 is set in a horizontal hole in the side of the paddle, and its opposite end is stabelized by a rotational stop pin 171.

4) At the lower end of the paddle 165, fasten a short extension piece 168, by hinge 169. The pin 245 of hinge 169 extends out of the sides of the extension assembly. The pin 245 supports a spring 234 that provides counterclockwise rotational tension on the extension piece 168. A lip bracket 235 limits the counterclockwise rotation of the extension piece 168, to a maximum of 180° from the paddle 165. Provide a retaining pin 216 at each end of pin 244. Provide a retaining pin 221 at each end of pin 245.

5) At the upper end of the paddle 165, provide a magnetically attractive plate 172, fastened parallel to and along the rear facing side of the paddle 165. Provide a bracket 173 supported electromagnet 174, adjacent the paddle hinge 243. The magnet's 174 support angle 173 is fastened to the underside of support arm 164. The magnet 174 driven paddle typically provides a step type propulsion of the switching mechanism 121. (refer again to FIG. 21)

6) Additionally, provide the switching mechanism 121 with a vertical reciprocating sled base stabelizing assenbly 175. A secondary rectangular base block 176, is mounted on the top surface of the sled base 159. A horizontally aft facing lower support arm 177 is supported by an angle bracket 178, to the rear vertical surface of the secondary base block 176. And a horizontally aft facing upper support arm 179, is supported by its fastening to the aft top surface of the secondary base block 176. The bar 179 is aligned directionally above the lower support arm 177. (cont. ref. to FIG. 21)

7) A vertical elongated reciprocating wedge rod 180 is fastened in and extending out of the top surface of a wedge 181. The wedge 181 has been modified by the removal of its bottom apex 182. The rod 180 extends vertically through the lower arm 177 and the upper arm 179. A rod retaining pin 183 is set horizontally through the top end of the rod 180. A rectangular shaped electromagnet 185 is attached to the bottom surface of arm 179. The electromagnet 185 has a vertical elongated hole through its center 257. A recoil spring 186, encompasses the rod 180, and extends from the top of the wedge 181, to the spacer plate 187 that is fastened to the bottom surface of lower arm 177. A lower arm 177 length extending member 188, which is made of non magnetically attractive material, is fastened to the top surface of the lower arm 177, and extends in an aft direction. Rod 180 is stationarily fastened in a rectangular attractor block 184. Block 184 carries bracket 254, which is provided with a guide hole 253. Line 204 extends from its slideable lever 196 fastening, over pulley 202, down through hole 253 and is is fastened to horizontal stop pin 255. Coil return spring 256 is fastened to the 204 line end. The unfastened end of the spring 256 is fastened to the top surface of arm extension 188. The specified arrangement allows movement of the switching mechanism 121, while line 204 remains stationary.

8) A wedge tune circuit extension conductor line 189, is provided. The line 189 extends the circuit from wedge end surface 190, over the top of the wedge 181, to 191, on the opposite side of the wedge. End surface 190 carries conducting contact 192. End surface 191 carries conducting contact 193. The line 189 connects contacts 192 and 193. The line 189 is insulated, except for its points of contact.

9) When electromagnet 174 is actuated and the pendulum 165 is pulled in a clockwise direction, the pendulum engages the wall of a track wedge recess 157, and causes the sled base 159 to travel forward a distance equivalent to the eidth of the top of the track wedge recess 157. And since the pendulum electromagnet 174 and the reciprocating rod electromagnet 184 are actuated near simultaneously, while the sled base 159 is moved, the contact, 192 and 193, bearing wedge, travels up and bridges circuit from hex shaped surface contact 138 to hex shaped surface contact 139. This actuation sequence typically effects the production of a tone by an assembly 13. The wedge then drops into the next subsequent track wedge recess 157.

G. Apparatus for moving or disengaging the instrument 1 switching mechanism 121.

a. Provide a system of pulleys, lines, and hand operated levers, 194, for lifting the reciprocating wedge 181, and diverting the pendulum 165, so that the switching mechanism 121, can be slid to the left on the trackway 150, and removed from its track 150 engagement.

1) The system 194 includes a fixed lever 195 and a slideable lever 196 assembly 197, that are carried by the upper arm 179. The slideable lever 196 is connected to a plate 198, not shown, that supports two channels so that they form a shoe 199. The shoe 199 is slideable along upper arm 179.

2) A pulley 200 is fastened by bracket 201, not shown, to the slideable lever assembly 197. (cont. ref. to FIG. 21) A pulley 202 is fastened by bracket 203 to the trailing end of the upper arm 179. A pulley 206, that is vertically aligned below the slideable lever pulley 200, is mounted on an angle bracket 207, that is mounted on the top surface of the lower arm 177. A line 208 that is connected to the slideable lever 196, extends over pulley 200, drops vertically to pass under pulley 206, and extends horizontally forward to a fastening point 209 on a slideable pendulum diverter bracket 210 base 211. A base 211 track 217, which resembles a short length of I beam, is mounted on top of arm 164, and runs parallel to the arm. Base 211 holding spring 239, holds the base against a stop pin 240. The spring 239 and pin 240 are structurally supported to end post 241.

Figure 24:
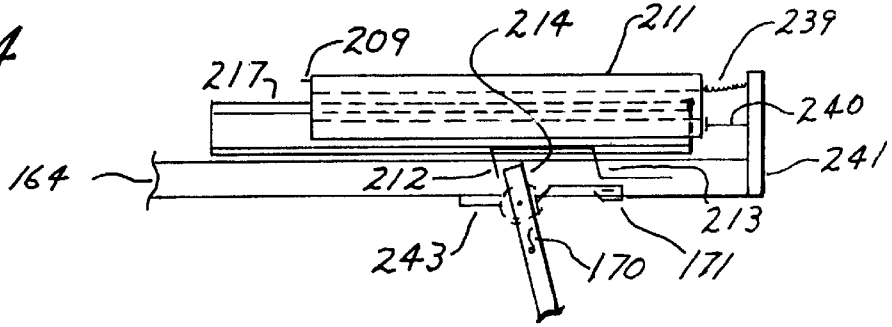
FIG. 24 is a partial elevation view of the opposite side of FIG. 23.

3) The diverter bracket's 210 near vertical members 212 and 213, engage the pendulum extension tab 214, when the bracket base 211 is moved forward or backward on track 217. Refer to FIG. 24 and note that the pendulum extension tab 214 does not engage the diverter bracket's near vertical members 212 and 213, while the switching mechanism 121 is used in playing a tune. (cont. ref to FIG. 21)

Figure 27:
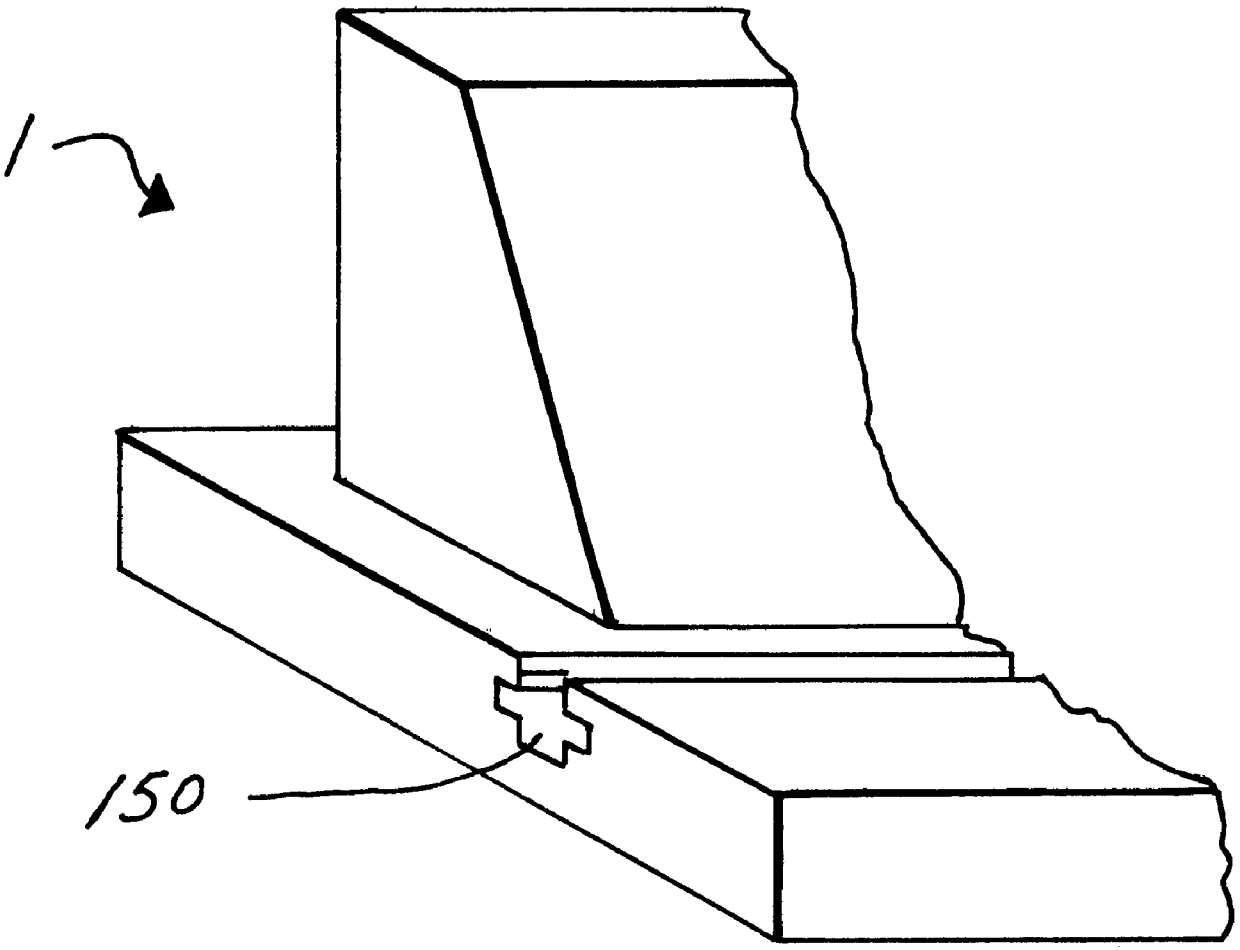
FIG. 27 is a conceptual perspective drawing showing provision for removing the circuit switching mechanism shown in FIG. 21, from the mechanism trackway.

4) When fixed lever 195, and slideable lever 196 are grasped and the slideable lever is squeezed toward the fixed lever 195, line 204 lifts the reciprocating wedge 180 out of the wedge recess 157 it is sitting in, and line 208 slides diverter bracket 211 rearward, causing the bracket to engage the pendulum tab 214, and rotate the pendulum 165 counterclockwise, and cause it to move into a near horizontal attitude, and disengage from contact with the wedge recess 157, it was sitting in. And when the hand operated lever system 194 has effected the actuation of these two assemblies, 162 and 175, the switching mechanism 121 can be slid out of the trackway 150 via the instrument's 1 left side. (see FIG. 27) And, by the same token, the switching mechanism 121 can be disengaged, and moved to a previously played tone assembly 13, line 119, to simplify the composing process.

Figure 26:
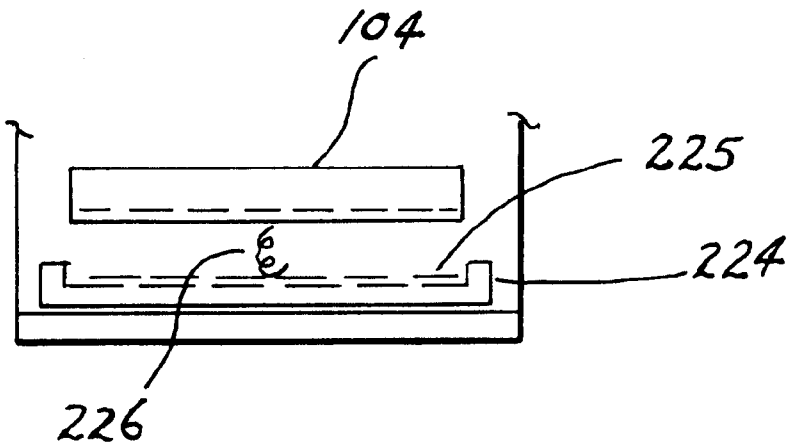
FIG. 26 is a frontal elevation of the tap key shown in FIG. 25.
Figure 25:
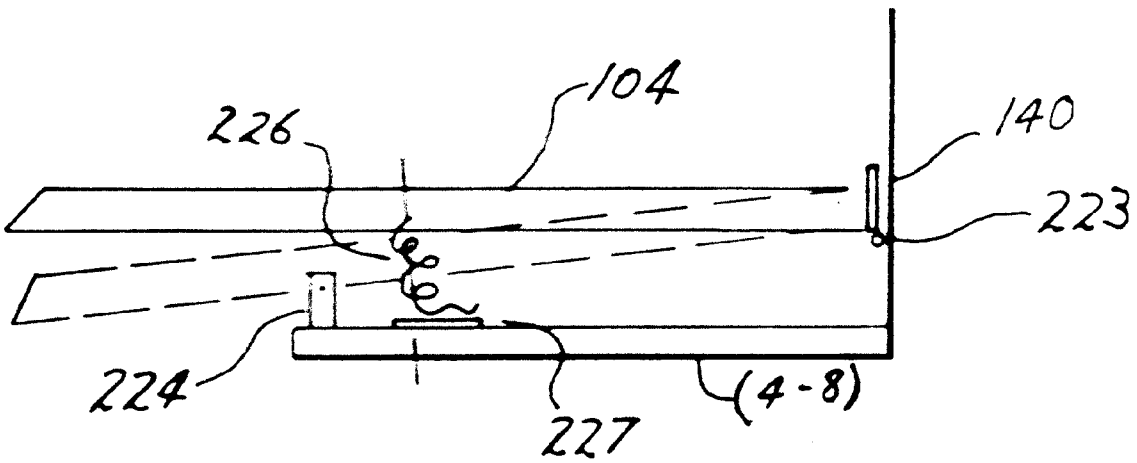
FIG. 25 is a side elevation view showing the components of the instrument tap key.

H. Apparatus for actuating the tune circuits of the instrument 1 by rythmically tapping a key 104 (refer back to FIG. 1 and FIG. 2)

a. Provide an instrument tap key 104 that on bottoming, when it is depressed, produces actuation of an instrument tone producing assembly 13. The key would follow the up and down motion of an instrument 1 players tapping finger. Refer to FIG. 25 and FIG. 26

1) Provide an elongated, wide key member 104, hinge 223 fastened to the instrument hinge board 140. Provide a U shaped key bottoming stop 224. The recessed surface of the U shaped stop 224, has a piece of felt 225 glued to it to soften tap key 104 bottoming. Provide a coiled compression key return spring 226. The spring 226 is fasyened in a near vertical upward extending attitude, set on and fastened to a beveled base plate 227. The base plate 227 is fastened to the upper surface of the instrument's 1 bottom panel, one of the (4–8) specified above.

I. Electrical apparatus for a mechanical electrically powered, hand played music box.

a. Provide electrical means specified and identified in the invention's electrical circuit diagram. (refer again to FIG. 11)

1) Provide sound amplification system elements including: a microphone 228, a speaker 229, and a rheostat 230 volume control. The microphone 228 and speaker 229, could be located approximately as shown in FIG. 2. Sound amplification would be controlled by the rheostat 230.

2) Provide a sound system on/off switch 231, located as shown in FIG. 1. Provide a potentiometer 237 as shown in FIG. 11. Provide an instrument on/off switch 238, as shown in FIG. 11, and located as shown in FIG. 1.

3) Provide battery 236, noted above, as a power source for the invention.

4) Provide a keyboard on/off switch 232.

Note 4:

Wire 260 connects key 99 contact 148 to sw. 232.

Wire 261 connects sw. 232 to 236 (–).

wire 262 connects 236 (–) to electromagnet 174.

Wire 263 connects electromagnet 174 to electromagnet 185.

Wire 264 connects electromagnet 185 to (+) side of 104.

Wire 265 connects (–) side of 104 to potentiometer 237.

Wire 266 connects 237 to 238.

Wire 267 connects 238 to 236 (+).

Wire 259 connects each assembly 13 to 237.

What is claimed is:

1. An electrically powered, hand played music box comprising:

musical tone producing means including, 88 reed and plectrum shuttle mechanism assemblies, each assembly having a reed, a plectrum carrying shuttle body, and two electromagnets, each said electromagnet having a directionally opposite attracting effect on said shuttle body;

means for accessing chromatic assembly tone circuits in groups of 29, said means comprising, an 88 chromatic assembly tone circuit plate having 88 electrical contacts, and a track supported slideable body having a leaf with 29 tone circuit electrical contacts;

a stationary plate having 29 tone circuit contacts for connecting said 29 accessed circuits electrically to a tune network base that is built into the instrument face;

tune network base means comprising, a set of parallel instrument face mounted tone circuit electrical contact plates, each said plate having 29 tone circuit electrical contacts, 29 semicircular horizontal and parallel grooves, said grooves cut into the surface of said instrument face, and 29 solid bare wire tone circuit electrical conductors, said conductors connecting corresponding electrical contacts on said parallel contact plates, each bare conducting wire is installed in said instrument's face surface so that its length is conductively exposed across said instrument's face surface;

a structurally framed tune board for supporting a plurality of pre-set line bearing contacts to said tune network base;

a structurally framed composing tune board for supporting a plurality of slideable contacts that serve as conductors between a composing board's conducting rods, and the instrument face bare conducting wires;

a primary conductor line extension sheet for connecting each said tune board contact line electrically to a corresponding stationary hex shaped tone circuit switch contact;

composing, tone verifying means, comprising, a 29 chromatic tone keyboard, said board having 29 identical white keys, said keys being numbered 1 to 29, said keys each being in circuit with and capable of actuating, on depression, a corresponding tone producing assembly among the said 29 accessed assemblies;

assembly tone circuit switching means comprising a tune circuit switching mechanism, said mechanism having an electromagnetically actuated pendulum paddle propeller, a unitized mechanism trackway, a vertically reciprocating wedge stabelizer, and a tone circuit electrical extension conductor line;

a secondary conductor line extension sheet for electrically connecting each said hex shaped tone circuit switch contact's corresponding stationary hex shaped tone circuit switch contact extension line, to a line end, common wire connected, copper connector;

hand controlled switching mechanism track disengaging means, comprising, a pendulum diverter bracket, a sliding, moveable lever, a stationary lever, a pair of lever lines, and a set of pullies, for lifting a reciprocating wedge out of said track, and diverting a pendulum to a near horizontal attitude, to facilitate relocation or removal of said switching mechanism on or from said trackway;

a tap key for electrically actuating said tone producing assemblies by rythmically tapping said key;

electrical means comprising a microphone, a speaker, a speaker volume control, a keyboard on-off switch, an amplifying system on-off switch, a potentiometer, a battery, and an instrument on-off switch.

2. The electrically powered, hand played music box of claim 1 wherein said musical tone producing means further comprises assembly elements that include a frame, said frames bottom horizontal member supporting a shuttle track, an elongated horizontal rod, said rod being fastened in said shuttle body, and passing through a horizontal hole in each said electromagnet, each rod unfastened end having a coiled rod restrainer spring fastened to it, each rod unfastened end having a circular piece attached to it, said frame's bottom horizontal member supporting a bracket supported, elongated, spring enclosing cylindrical tube, each shuttle body having a shuttle body travel limiting magnetic attractor bracket surface attached to each of its vertical leading surfaces, wherein the magnetic attraction of said bracket causes said rod to compress said spring and thereby ease said shuttle's travel limiting attractor bracket into the stopping attractor magnet.

3. The electrically powered, hand played music box of claim 2 wherein said musical tone producing means further comprises circuit means that include a pair of complimentary latching and contacting switch units, each unit comprising a lift electromagnet that is supported to said shuttle body by a probe, said probe extending horizontally out from the top of said body, parallel to and spaced above a flexible arm supported latch-contact element, said complimentary switch unit probe being disposed dimetrically along said body's top surface, wherein the introduction of current to said instrument's circuit flows to the lift electromagnet of the switch unit that is disposed in a shuttle latching mode, unlatching said shuttle and then flowing to said shuttle's most remote said attractor electromagnet, causing said electromagnet to become energized and attract said shuttle to itself, and wherein said shuttle's travel causes said plectrum to pluck said reed and thereby produce a musical tone.

4. The electrically powered, hand played music box of claim 3 wherein said musical tone producing means further comprise a pair of magnetically responsive damping shoes, each said shoe being flexibly supported by bracket to said assembly frame, a pair of damping shoe attractor electromagnets, each said damping shoe electromagnet being stationarily supported to said assembly frame, wherein said shoes are normally disposed on arms in a reed damping attitude, that is, resting lightly against said reed, while said shoe attractor electromagnets are disposed spaced away from said shoes, wherein said shuttle attractor electromagnet's energizing current simultaneously energizes said shoe attractor electromagnets causing said damping shoes to be lifted from their damping attitude before the encounter of said lagging plectrum with said reed.

5. The electrically powered, hand played music box of claim 4 wherein said assembly tone group circuit accessing means further comprises a rectangular body holding bar, said bar having 60 slots, said slots corresponding to said tone circuit contacts 1 through 60, said individual slots being labeled 1 through 39, "C", and 41 through 60, and a hand operated, tension spring offset, L shaped body holding lever with a tab extension on its horizontal member, wherein on actuation of said lever, said tab is lifted from its resident slot, said body can be freely slid to a selected assembly group's number 1 slot position, and said handle released, causing said tab to seat in the number 1 slot, thereby locking onto and accessing a 29 chromatic tone group contact segment of said 88 contacts.

6. The electrically powered, hand played music box of claim 1 wherein said tune board means further comprise, a plurality of ribs, said ribs being disposed parallel and equally spaced apart by end spacer plates, said ribs and plates forming a structural frame, said frame having four corner pin slots, said slots providing alignment of said board on said instrument face tune network base, said board having a bottom base sheet, said base sheet having a plurality of resiliant contacts mounted on its unfastened surface, said contacts being preset and fastened in manufacture, in a configuration that represents a specific musical number.

7. The electrically powered, hand played music box of claim 1 wherein said tune board means further comprise, a plurality of elongated contact conductor lines, each said contact having a conductor line connected to it, wherein the unconnected end of each conductor line is fastened to the edge surface of said tune board frame, and wherein said line ends constitute a horizontal array of assembly tone circuit lines that are parallel, equally spaced apart, electrical contact surfaces, said surfaces amounting to a sequenced placement of the tones of a musical number.

8. The electrically powered, hand played music box of claim 1 wherein said composing tune board means further comprise, a plurality of ribs, each said rib having a slot through its length dimension and thus resembling an inverted U, said ribs being disposed parallel and equally spaced apart by end spacer plates, said ribs and plates forming a structural frame, said frame having four corner pin slots, said slots providing alignment of said board on said instrument face tune network base.

9. The electrically powered, hand played music box of claim 8 wherein said composing tune board means further comprise, a plurality of conductor rods wherein each said rib carries a rod in its elongated slot, and each said rod's lower end segment is wrapped under the lower edge of said structural frame, and wherein said rod ends constitute a horizontal array of parallel, side by side, equally spaced apart, assembly tone circuit electrical contact surfaces, said surfaces amounting to a sequenced placement of the tones of a musical number.

10. The electrically powered, hand played music box of claim 1 wherein said slideable contacts further comprise, a flat somewhat thicker center piece sandwiched and through bolted between two flat side pieces, said side pieces enclosing said rib, said center piece slideably engaging said rib's top surface, a flexible conductor, wherein said flexible conductor, carried on a body through bolt, extends up into said rib's slot, in compression contact with said conductor rod, wherein said body is disposed slideably stabelized to said rib, and movement of said body provides electrical contact between said flexible conductor's bottom member and any one of said tune network's 29 assembly tone conductors.

11. The electrically powered, hand played music box of claim 1 wherein said assembly tone circuit switching means further comprise, a mechanism sled body, said body having a pair of elongated runners, said runners supporting said body to a pair of elongated channel trackways, wherein said unitized trackway further comprises a series of wedge shaped recesses, and wherein said electromagnetically actuated pendulum encounters the inclined side of a wedge to provide specific forward sled movement.

12. The electrically powered, hand played music box of claim 8 wherein said assembly tone circuit switching means further comprise an elongated reciprocating rod, said rod having a wedge fastened to its lower end, said wedge having said tune circuit extension conductor line fitted to its top and sides, said rod having an attractor electromagnet stationarily fastened to it, said rod having an encompassing recoil spring wherein actuation of said attractor electromagnet causes said wedge fitted conductor line ends to encounter said stationary track face hex contacts and mechanically complete the electrical extension of an assembly tone circuit, thereby producing a musical tone.

* * * * *